US011674250B2

(12) United States Patent
Kwon et al.

(10) Patent No.: US 11,674,250 B2
(45) **Date of Patent: *Jun. 13, 2023**

(54) LAUNDRY TREATING APPARATUS AND METHOD FOR CONTROLLING THE APPARATUS

(71) Applicant: LG ELECTRONICS INC., Seoul (KR)

(72) Inventors: Oshin Kwon, Seoul (KR); Keunjoo Kim, Seoul (KR); Byunghyun Moon, Seoul (KR); Dongsoo Lee, Seoul (KR); Jaeyong Jeong, Seoul (KR); Aekyung Chae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 803 days.

This patent is subject to a terminal disclaimer.

(21) Appl. No.: 16/611,941

(22) PCT Filed: Oct. 1, 2018

(86) PCT No.: PCT/KR2018/011634
§ 371 (c)(1),
(2) Date: Nov. 8, 2019

(87) PCT Pub. No.: WO2019/066613
PCT Pub. Date: Apr. 4, 2019

(65) Prior Publication Data

US 2021/0087735 A1 Mar. 25, 2021

(30) Foreign Application Priority Data

Sep. 29, 2017 (KR) ..... 10-2017-0127753

(51) Int. Cl.
*D06F 33/34* (2020.01)
*D06F 33/36* (2020.01)
(Continued)

(52) U.S. Cl.
CPC ..... *D06F 33/36* (2020.02); *D06F 23/04* (2013.01); *D06F 31/00* (2013.01); *D06F 33/54* (2020.02);
(Continued)

(58) Field of Classification Search
CPC ..... D06F 21/00; D06F 21/06; D06F 21/08; D06F 23/00; D06F 23/04; D06F 29/00;
(Continued)

(56) References Cited

U.S. PATENT DOCUMENTS 8,959,688 B2 2/2015 Im et al.
2004/0200093 A1* 10/2004 Wunderlin ..... D06F 34/08 34/606
(Continued)

FOREIGN PATENT DOCUMENTS

CN 101165262 A 4/2008
CN 202124754 U 1/2012
(Continued)

OTHER PUBLICATIONS

Chinese Office Action in Application No. 201880038660.5 dated Mar. 3, 2021 (11 pages).
(Continued)

*Primary Examiner* — David G Cormier
(74) *Attorney, Agent, or Firm* — Birch, Stewart, Kolasch & Birch, LLP

(57) ABSTRACT

A method for controlling a laundry treating apparatus is disclosed. The apparatus comprises a main-drum and an auxiliary-drum selectively mounted on or separated from the main-drum. The method may comprise: a main laundry quantity detection operation for detecting a laundry quantity in the main-drum via rotation of a pulsator disposed in the main-drum; and an auxiliary laundry quantity detection operation for detecting a laundry quantity in the auxiliary-
(Continued)

drum by driving the main-drum, wherein the auxiliary laundry quantity detection operation is performed based on the main laundry quantity detected in the main laundry quantity detection operation.

15 Claims, 6 Drawing Sheets

(51) Int. Cl.

| | |
|---|---|
| ***D06F 33/56*** | (2020.01) |
| ***D06F 33/54*** | (2020.01) |
| ***D06F 33/60*** | (2020.01) |
| ***D06F 23/04*** | (2006.01) |
| ***D06F 31/00*** | (2006.01) |
| *D06F 103/04* | (2020.01) |
| *D06F 103/46* | (2020.01) |
| *D06F 101/20* | (2020.01) |
| *D06F 34/18* | (2020.01) |
| *D06F 105/02* | (2020.01) |
| *D06F 105/08* | (2020.01) |
| *D06F 103/18* | (2020.01) |
| *D06F 103/24* | (2020.01) |
| *D06F 105/46* | (2020.01) |
| *D06F 105/54* | (2020.01) |
| *D06F 105/58* | (2020.01) |
| *D06F 105/60* | (2020.01) |
| *D06F 101/00* | (2020.01) |

(52) U.S. Cl.
CPC ..... *D06F 33/56* (2020.02); *D06F 33/60* (2020.02); *D06F 33/34* (2020.02); *D06F 34/18* (2020.02); *D06F 2101/00* (2020.02); *D06F 2101/20* (2020.02); *D06F 2103/04* (2020.02); *D06F 2103/18* (2020.02); *D06F 2103/24* (2020.02); *D06F 2103/46* (2020.02); *D06F 2105/02* (2020.02); *D06F 2105/08* (2020.02); *D06F 2105/46* (2020.02); *D06F 2105/54* (2020.02); *D06F 2105/58* (2020.02); *D06F 2105/60* (2020.02)

(58) Field of Classification Search
CPC ..... D06F 31/00; D06F 33/34; D06F 33/36; D06F 33/54; D06F 33/56; D06F 34/18; D06F 34/20; D06F 37/12; D06F 2103/04; D06F 2103/46
See application file for complete search history.

(56) References Cited

U.S. PATENT DOCUMENTS

| | | | | |
|---|---|---|---|---|
| 2013/0119047 | A1* | 5/2013 | Driussi | H05B 3/02 219/507 |
| 2019/0017212 | A1* | 1/2019 | Bergamo | D06F 13/00 |
| 2019/0360142 | A1* | 11/2019 | Woo | D06F 37/40 |

FOREIGN PATENT DOCUMENTS

| | | | |
|---|---|---|---|
| CN | 103403245 | A | 11/2013 |
| CN | 205275962 | U | 6/2016 |
| JP | 2000-167299 | A | 6/2000 |
| JP | 2005-168866 | A | 6/2005 |
| JP | 2010-264053 | A | 11/2010 |
| KR | 10-2003-0037562 | A | 5/2003 |
| KR | 10-2004-0095460 | A | 11/2004 |
| KR | 10-2008-0085392 | A | 9/2008 |
| KR | 10-2013-0091590 | A | 8/2013 |
| KR | 10-2015-0025734 | A | 3/2015 |
| KR | 10-2015-0030806 | A | 3/2015 |
| KR | 10-2016-0118124 | A | 10/2016 |

OTHER PUBLICATIONS

Indian Office Action in Application No. 201917045123 dated Jul. 5, 2021 (6 pages).
PCT International Search Report for corresponding International Application No. PCT/KR2018/011634, dated Jan. 22, 2019 (16 pages).

* cited by examiner

LAUNDRY TREATING APPARATUS AND METHOD FOR CONTROLLING THE APPARATUS

CROSS-REFERENCE TO RELATED APPLICATIONS

This application is a National Phase of PCT International Application No. PCT/KR2018/011634 filed on Oct. 1, 2018, which claims the benefit of priority under 35 U.S.C. § 119(a) to Korean Patent Application No. 10-2017-0127753, filed on Sep. 29, 2017, the contents of all of which are hereby incorporated by reference in their entireties as if fully set forth herein.

TECHNICAL FIELD

The present disclosure relates to the laundry treating apparatus. Specifically, the present disclosure relates to a laundry treating apparatus and method for controlling the apparatus, in which an auxiliary-drum is removable from a main-drum.

BACKGROUND ART

A laundry treating apparatus is a device for washing, drying, or refreshing laundry, and is provided in various forms such as a washing machine, a drying machine, a washing and drying machine, and a refresher.

Unlike a refresher which is provided in the form of a closet and in which a space where the laundry is accommodated is fixed, in a laundry treating apparatus that performs washing or drying, it is common that a drum accommodating laundry therein is rotated.

The drum is formed in a cylindrical shape, and washing and drying may be carried out while the laundry accommodated in the drum moves as the drum rotates. To carry out washing, the laundry treating apparatus includes a tub for receiving laundry. The drum is rotated inside the tub while washing is performed.

The laundry treating apparatus may be divided into a front loader type and a top loader type depending on the direction in which laundry is loaded into the drum or the rotational axis of the drum. In the front loader type, laundry is fed into the drum from the front of the laundry treating apparatus, and the drum is rotated about the horizontal axis of rotation parallel to the ground. In the top loader type, laundry is injected into the drum from above the laundry treating apparatus, and the drum rotates about a rotational axis substantially perpendicular to the ground.

Generally, only one drum is provided in one washer or dryer. Therefore, depending on the type of laundry, separate washing or drying cannot be performed at the same time. In order to solve such a problem, recently, a laundry treating apparatus having two drums is provided. In the case of the laundry treating apparatus, there are two separate drums in one casing, washing and drying may be performed simultaneously on two drums respectively. This laundry treating apparatus may be called a twin laundry treating apparatus.

The twin laundry treating apparatus is a combination of a conventional laundry treating apparatus and a separate laundry treating apparatus. Thus, although the twin laundry treating apparatus may be referred to as a single laundry treating apparatus, it may actually be a complex implementation of two laundry treating apparatuses. This is because a separate auxiliary-drum is provided on or below the existing drum, and driving units for driving these drums are inevitably provided separately in the twin laundry treating apparatus. Therefore, the size of the twin laundry treating apparatus is inevitably increased, and the complex structure and manufacturing cost thereof are inevitably increased.

On the other hand, a drum in a washing machine may be called an inner tub or an outer tub. In other words, the drum which is a unit accommodating the laundry may be called the inner tub. However, in general, the tub accommodating washing water has a configuration that it is not exposed to the user. Therefore, the drum may be simply called a tub.

Accordingly, the twin laundry treating apparatus has a tub and a tub arranged in parallel, and may be called a tub-by-tub laundry treating apparatus.

The applicant of the present invention has proposed Korean Patent Application No. 10-2016-0051336 (hereinafter referred to as "prior invention") in which in order to overcome the limitation in the twin laundry treating apparatus, the applicant has also provided a laundry treating apparatus in which an auxiliary-drum may be detached from the main-drum.

In the prior art invention, separated washings may be enabled in two separate drums, while the auxiliary-drum could be inserted into the main-drum to prevent the laundry treating apparatus from increasing in size. Further, since the driving force for rotating the auxiliary-drum uses a driving force for rotating the main-drum, no separate driving unit is required. Thus, the simple structure minimized the increase in manufacturing cost.

A laundry treating apparatus of the same type as a prior invention may be referred to as a laundry treating apparatus in which an auxiliary-drum (the second tub) containing laundry is inserted into the main tub (the first tub) where laundry is received. Thus, in order to distinguish this type of laundry treating apparatus from the tub-by-tub laundry treating apparatus, this type may be referred to as a tub-in-tub laundry treating apparatus.

However, the prior art invention mainly discloses the structural characteristics of the tub-in-tub laundry treating apparatus and does not disclose a control method for effective washing.

For example, in a tub-in-tub laundry treating apparatus, after the auxiliary-drum is mounted on the main-drum, only the laundry contained in the auxiliary-drum may be washed. For convenience of illustration, this may be referred to as "auxiliary washing". For convenience of illustration, this may be referred to as "simultaneous washing". Further, the apparatus may wash the laundry in the auxiliary-drum and main-drum together. For convenience of illustration, this may be called "simultaneous washing". These auxiliary washing and simultaneous washing are very different from "general washing" in which only the laundry contained in the main-drum is washed after the auxiliary-drum is separated.

In the general washing, various algorithms are provided to enhance the washing effect. However, in the case of the auxiliary washing and simultaneous washing, research and development for performing optimal washing has not been conducted.

According to the prior art described above, three different types of washing (auxiliary washing, simultaneous washing, and general washing) may be performed as described above. Thus, the need to provide a laundry treating apparatus, which can perform optimal washing in each of three different types of washing (auxiliary washing, simultaneous washing, and general washing) and a method for controlling the apparatus, cannot be overemphasized.

Further, in order to carry out washing or rinsing, it is desirable to supply proper washing water quantity according to laundry quantity. To do this, an accurate laundry quantity must first be detected. However, in the case where only one drum is provided, many laundry quantity sensing schemes are proposed, while when two drums operate in an associated manner, there is no way to accurately detect the laundry quantity for each drum.

Therefore, it is necessary to provide a method that can accurately detect a main laundry quantity and an auxiliary laundry quantity, respectively, and perform optimal laundry processing based on the detected quantities.

Technical Problem

The present disclosure aims to solve the above-mentioned conventional problems.

One embodiment of the present disclosure is intended to provide a laundry treating apparatus and method for controlling the apparatus, which can eliminate the inaccuracy of the sensed auxiliary laundry quantity due to the water initially contained in the auxiliary-drum and implement an optimum washing effect via the auxiliary-drum.

One embodiment of the present disclosure is intended to provide a laundry treating apparatus and method for controlling the apparatus, which can supply an optimum washing water quantity to an auxiliary-drum and implement an optimum washing effect via an auxiliary-drum.

One embodiment of the present disclosure is intended to provide a laundry treatment apparatus and method for controlling the apparatus, which can remove inaccuracies in the sensed main laundry quantity caused by the water contained in the auxiliary-drum when detecting the main laundry quantity contained in the main-drum by rotating the main-drum, and implement an optimal washing effect via the main-drum.

One embodiment of the present disclosure is intended to provide a laundry treating apparatus and method for controlling the apparatus, which can more accurately detect a laundry quantity in the auxiliary washing or simultaneous washing and can perform optimal washing based on the sensed laundry quantity.

One embodiment of the present disclosure is intended to provide a laundry treating apparatus and method for controlling the apparatus, which allows a user to easily select and use one mode among a general washing mode, an auxiliary washing mode, and a simultaneous washing mode.

One embodiment of the present disclosure is intended to provide a laundry treating apparatus and method for controlling the apparatus, which can automatically set an optimum mode and perform the set mode even when the user does not select one among the general washing mode, auxiliary washing mode and simultaneous washing mode.

One embodiment of the present disclosure is intended to provide a laundry treating apparatus and method for controlling the apparatus, which allows whether or not the auxiliary-drum is mounted to be determined automatically via rotation of the main-drum when the user closes the door of the laundry treating apparatus and inputs the start input, thereby to ensure safeness and prevent misuse.

One embodiment of the present disclosure is intended to provide a laundry treating apparatus and method for controlling the apparatus, which automatically determine whether or not the auxiliary-drum is mounted and determine the loads of the auxiliary-drum and the main-drum, and automatically set, based on the determination results, a mode of the general washing mode, the auxiliary washing mode, and the simultaneous washing mode and perform the set mode. Further, one embodiment of the present disclosure is intended to provide a laundry treating apparatus and method for controlling the apparatus, in which when the user selects one of the three modes through the user interface, and the mode selected by the user and the determination result by the laundry treating apparatus (whether the auxiliary-drum is mounted, the load of the main-drum and the load of the auxiliary-drum) are compared with each other, and, then, malfunctions and mistakes may be prevented in advance on the basis of the comparison result. One example of the present disclosure is intended to provide a laundry treating apparatus and method for controlling the apparatus, in which when there is no laundry in the main-drum, and laundry is in the auxiliary-drum, the simultaneous washing is performed.

One embodiment of the present disclosure is intended to provide a laundry treating apparatus and method for controlling the apparatus, which automatically determine whether the user has entered auxiliary washing and whether the auxiliary-drum is installed, thus, to minimize the user's actions, and automatically perform one of the general washing mode, the auxiliary washing mode and the simultaneous washing mode.

One embodiment of the present disclosure is intended to provide a laundry treating apparatus and method for controlling the apparatus, which effectively detects the laundry quantity stored in the auxiliary-drum, to allow optimum washing by the auxiliary-drum.

One embodiment of the present disclosure is intended to provide a laundry treating apparatus and method for controlling the apparatus, which allows optimal washing via applying different quantities of water supply according to the laundry quantity accommodated in the auxiliary-drum. Further, one embodiment of the present disclosure is intended to provide a laundry treating apparatus and method for controlling the apparatus in which the optimum washing water quantity may be supplied to the auxiliary-drum via the water supply time variation.

One embodiment of the present disclosure is intended to provide a laundry treating apparatus and method for controlling the apparatus, in which in the case of simultaneous washing, the laundry quantity detection in the main-drum and the laundry quantity detection in the auxiliary-drum are individualized, to allow effectively detecting each laundry quantity in each drum, which allows the optimal washing by the main-drum and auxiliary-drum.

Technical Solution

In one aspect of the present disclosure, there is provided a method for controlling a laundry treating apparatus, wherein the apparatus comprises a main-drum and an auxiliary-drum selectively mounted on or separated from the main-drum, wherein the method comprises: a main laundry quantity detection operation for detecting a laundry quantity in the main-drum via rotation of a pulsator disposed in the main-drum; and an auxiliary laundry quantity detection operation for detecting a laundry quantity in the auxiliary-drum by driving the main-drum, wherein the auxiliary laundry quantity detection operation is performed based on the main laundry quantity detected in the main laundry quantity detection operation.

That is, the components (in one example, main-drum and pulsator) that are driven for the main laundry quantity detect operation and the auxiliary laundry quantity detect operation, respectively, may be provided individually. In other words, the main laundry quantity is detected via the driving of the pulsator which affects only the laundry quantity in the main-drum, and, then, the auxiliary laundry quantity may be detected based on the detected main laundry quantity and via driving the main-drum.

This can accurately detect the main laundry quantity and the auxiliary laundry quantity respectively. Thus, the main washing with the main-drum and auxiliary washing with the auxiliary-drum can be effectively implemented optimally.

The laundry treating apparatus may be configured to perform: a general washing mode in which laundry in the main-drum is washed while the auxiliary drum separated from the main drum; an auxiliary washing mode in which only laundry in the auxiliary-drum is washed while the auxiliary-drum is a mounted on the main-drum; and a simultaneous washing mode in which laundry in the auxiliary-drum and laundry in the main-drum are washed while the auxiliary-drum is mounted on the main-drum. That is, two laundry treatment locations can be effectively operated by using a single laundry treating apparatus.

Preferably, the main laundry quantity detection operation and the auxiliary laundry quantity detection operation may be sequentially performed in the simultaneous washing mode. That is, the main laundry quantity detection is preferably performed before the auxiliary laundry quantity detection. This is because of followings: since the auxiliary-drum is provided in dependence on the main-drum, the laundry quantity detection in the auxiliary-drum should be dependent on the laundry quantity detection in the main-drum, Thus, it may be preferable that the method detects the laundry quantity in the main-drum, which may be independent, and then, detects the laundry quantity in the dependent auxiliary-drum based on the main laundry quantity. In other words, it is desirable to estimate the laundry quantity in auxiliary-drum with considering the pre-detected main laundry quantity. The method may further include an operation for determining whether the auxiliary-drum is mounted on the main-drum. That is, the determination operation may determine whether the washing mode is a general washing mode, an auxiliary washing mode, or a simultaneous washing mode.

The operation for determining whether the auxiliary-drum is mounted on the main-drum may be performed by rotating the main-drum. In one example, this determination operation may be performed by rotating the main-drum by one rotation.

The operation for determining whether the auxiliary-drum is mounted on the main-drum may be performed before the main laundry quantity detection operation. A quantity of water corresponding to the quantity as determined by the laundry quantity detection may be supplied. Thus, it is desirable to determine whether the water-supply is to be performed, and to determine the location of the water-supply, before the water-supply and before the laundry quantity detection.

The laundry treating apparatus may include a control panel provided with a start/pause input interface that the user activates to allow the apparatus to start laundry treatment; and a door for opening and closing an opening defined in the main-drum, wherein after the door is closed and the start/pause input interface is activated, the operation for determining whether the auxiliary-drum is mounted on the main-drum is performed. The start/pause input interface is basically a component that is activated so that the user starts the operation of the laundry treating apparatus after performing all the target selections by the user. That is, the user inputs the input interface with assumption that the user recognizes that the laundry treatment is performed according to the flow that is subsequently input. In addition, the closed state of the door means that the internal actuation in the laundry treating apparatus does not physically affect the outside thereof. Therefore, after the door is closed based on the user's intention, and, then, when the main-drum is driven, whether or not the auxiliary-drum is mounted may be determined. This may ensure a more stable use of the laundry treating apparatus. That is, this is because of followings: when the door is closed and then the operation of the laundry treating apparatus is automatically performed by the user's selection, an effect of this automatic operation on the outside of the laundry treating apparatus physically (via change of temperature and rotation of the washing water and the drum, etc.) may be negligible.

The control panel may include: an auxiliary washing input interface which is activated by the user to select the auxiliary washing mode; and a simultaneous washing input interface which is activated by the user to select the simultaneous washing mode, wherein the simultaneous washing mode is performed automatically when a selection of the auxiliary washing mode is deactivated and when it is determined based on the determination result that the auxiliary-drum is mounted on the main-drum.

The general washing mode may be performed automatically when a selection of the auxiliary washing mode is deactivated and when it is determined based on the determination result that the auxiliary-drum is not mounted on the main-drum.

The auxiliary washing mode may be performed automatically when a selection of the auxiliary washing mode is activated and when it is determined based on the determination result that the auxiliary-drum is mounted on the main-drum.

Thus, basically, the general washing mode and another mode may be performed automatically, based on whether or not the user wears the auxiliary drum on the main drum. Furthermore, when the user selects the auxiliary washing mode, the auxiliary washing mode among the simultaneous washing mode and the auxiliary washing mode may be performed. It may be expected that the use frequency of the simultaneous washing mode will be higher than that of the auxiliary washing mode. Therefore, this may remove the separate activation input from the user for the most commonly used mode. Therefore, the use of this apparatus may be very convenient.

The method may further include: a main water-supply operation for supplying the washing water into the main-drum; and an auxiliary water-supply operation for water-supplying washing water into the auxiliary drum after the main water-supply operation is finished. That is, the main water-supply operation is preferably performed before the auxiliary water-supply operation.

The main laundry quantity detection operation may be performed after the water supply is performed in the main water supply operation. In other words, it is desirable to detect the main laundry quantity in the wet laundry where basic laundry water quantity may be supplied. The basic washing water quantity may be set at a minimum. In one example, this may be pre-set as the washing water quantity corresponding to the smallest laundry quantity as pre-described. In the wet laundry condition, laundry may be in a close contact with the pulsator. Thus, this may allow more effectively detecting the main laundry quantity in the main laundry as performed using the driving of the pulsator.

The laundry treating apparatus may include a water supply disposed above the main-drum to discharge the washing water, wherein the method further comprises an operation for controlling a position of the auxiliary drum before the main water-supply operation and the auxiliary water-supply operation is performed, thereby to allow the washing water discharged from the water supply to be supplied to either the main drum or the auxiliary drum.

The method may further include, after the main laundry quantity detection operation, an additional water-supply operation for optionally supplying the water into the main-drum based on the detected main laundry quantity. In one example, in the case of a main laundry quantity corresponding to the amount of the washing water larger than the washing water as supplied in the main water-supply, the additional water-supply may be performed. The amount of water-supply may be determined by the laundry quantity and thus a very effective main washing may be performed.

The auxiliary laundry quantity detection operation is performed after the optional additional water-supply operation. When the additional water-supply is not performed, the auxiliary laundry quantity detection may be performed immediately after the main laundry quantity detection.

The laundry treating apparatus includes a motor for driving the main-drum and the pulsator, wherein in the auxiliary laundry quantity detection operation, the auxiliary laundry quantity corresponds to a value calculated by subtracting a current value corresponding to the detected main laundry quantity from a current value measured in the motor when the main-drum rotates. That is, the auxiliary laundry quantity may be calculated using the load variation of the motor by driving the main-drum and the load corresponding to the pre-described main laundry quantity.

In the auxiliary laundry quantity detection operation, the auxiliary laundry quantity corresponds to a value calculated by subtracting a slip angle corresponding to the detected main laundry quantity from a slip angle upon braking the main-drum after rotation of the main-drum. As the auxiliary laundry quantity increases, the slip angle increases. That is, for the same main laundry quantity, when the auxiliary laundry quantity increases, the slip angle is increased. Thus, it is possible to effectively detect the auxiliary laundry quantity using this increase tendency of the slip angle.

The auxiliary water-supply operation may be configured to water-supply the washing water based on the auxiliary laundry quantity detected by the auxiliary laundry quantity detection operation after the auxiliary laundry quantity detection operation. In other words, as the auxiliary laundry quantity becomes larger, the method increases the washing water quantity, to perform more effective washing.

The auxiliary washing water quantity in the auxiliary water-supply operation is controlled based on a duration for which the washing water is supplied through the water supply. Since the electronic parts are not provided in the auxiliary drum, the amount of water-supply can be effectively controlled by using a time period during which the water is supplied.

The method may further include a provisional spinning operation for discharging initially-remaining water in the auxiliary drum out of the auxiliary-drum by a centrifugal force resulting from a rotation of the main-drum before the main water-supply operation. The initially-remaining water quantity inside the auxiliary-drum causes a measurement error in the auxiliary laundry quantity. Moreover, this may also cause the measurement error in the main laundry quantity. Therefore, it is preferable to remove the initially-remaining water in order to minimize such measurement error.

After the provisional spinning operation, the main laundry quantity detection operation and the auxiliary laundry quantity detection operation may be performed. In other words, it is desirable to remove the initially-remaining water from the auxiliary drum before the laundry quantity detection, that may otherwise cause the measurement errors.

When the provisional spinning operation is started, the simultaneous washing mode or the auxiliary washing mode may be performed.

In another aspect of the present disclosure, there is provided a method for controlling a laundry treating apparatus, wherein the apparatus may include a main-drum and an auxiliary-drum selectively mounted on or separated from the main-drum, wherein the method may include: an auxiliary water-supply operation for water-supplying washing water into the auxiliary drum; and a provisional spinning operation for discharging initially-remaining water in the auxiliary drum out of the auxiliary-drum by a centrifugal force resulting from a rotation of the main-drum before the auxiliary water-supply operation, thereby to eliminate a measurement error of a laundry quantity in the auxiliary drum due to the initially-remaining water in the auxiliary drum, wherein the initially-remaining water remains in the auxiliary drum prior to a washing operation therein.

The method may further include, after the auxiliary water-supply operation, an auxiliary washing operation for washing laundry in the auxiliary-drum by driving the main-drum.

The method may further include, after the provisional spinning operation, an auxiliary laundry quantity detection operation for detecting a laundry quantity in the auxiliary-drum by driving the main-drum.

The auxiliary water-supply operation may be configured to water-supply the washing water based on the laundry quantity detected by the auxiliary laundry quantity detection operation.

The laundry treating apparatus may be configured to perform: a general washing mode in which laundry in the main-drum is washed while the auxiliary drum separated from the main drum; an auxiliary washing mode in which only laundry in the auxiliary-drum is washed while the auxiliary-drum is a mounted on the main-drum; and a simultaneous washing mode in which laundry in the auxiliary-drum and laundry in the main-drum are washed while the auxiliary-drum is mounted on the main-drum.

The method may further include, in the auxiliary washing mode or the simultaneous washing mode, controlling a position of the auxiliary-drum so that the auxiliary-drum moves to and stop at a specific rotation position by rotating and stopping the main drum.

The method may further include, in the simultaneous washing mode, a main water-supply operation for supplying the washing water into the main-drum; and a main laundry quantity detection operation for detecting a laundry quantity in the main-drum.

The auxiliary water-supply operation may be performed after the main water-supply operation.

The provisional spinning operation may be performed before the main water-supply operation.

The method may further include, after the provisional spinning operation, a main laundry quantity detection operation for detecting a laundry quantity in the main-drum by driving a pulsator provided in the main-drum, wherein the auxiliary laundry quantity detection operation is performed after the main laundry quantity detection operation is performed.

The auxiliary laundry quantity detection operation may be performed based on a main laundry quantity detected in the main laundry quantity detection operation.

The laundry treating apparatus may include a motor for driving the main-drum and the pulsator, wherein in the auxiliary laundry quantity detection operation, the auxiliary laundry quantity corresponds to a value calculated by subtracting a current value corresponding to the detected main laundry quantity from a current value measured in the motor when the main-drum rotates.

In the auxiliary laundry quantity detection operation, the auxiliary laundry quantity may correspond to a value calculated by subtracting a slip angle corresponding to the detected main laundry quantity from a slip angle upon braking the main-drum after rotation of the main-drum.

The method may further include an operation for determining whether the auxiliary-drum is mounted on the main-drum.

The operation for determining whether the auxiliary-drum is mounted on the main-drum may be performed by rotating the main-drum.

The operation for determining whether the auxiliary-drum is mounted on the main-drum may be performed before the provisional spinning operation.

The laundry treating apparatus may include: a control panel provided with a start/pause input interface that the user activates to allow the apparatus to start laundry treatment; and a door for opening and closing an opening defined in the main-drum, wherein after the door is closed and the start/pause input interface is activated, the operation for determining whether the auxiliary-drum is mounted on the main-drum is performed.

The control panel may include an auxiliary washing input interface which is activated by the user to select the auxiliary washing mode, wherein the simultaneous washing mode is performed automatically when a selection of the auxiliary washing mode is deactivated and when it is determined based on the determination result that the auxiliary-drum is mounted on the main-drum.

The general washing mode may be performed automatically when a selection of the auxiliary washing mode is deactivated and when it is determined based on the determination result that the auxiliary-drum is not mounted on the main-drum.

The auxiliary washing mode may be performed automatically when a selection of the auxiliary washing mode is activated and when it is determined based on the determination result that the auxiliary-drum is mounted on the main-drum.

Advantageous Effects

In accordance with one embodiment of the present disclosure, the laundry treating apparatus and method for controlling the apparatus may be provided, in which the user can easily select one of the general washing mode, the auxiliary washing mode and the simultaneous washing mode and use the selected one.

In accordance with one embodiment of the present disclosure, the laundry treating apparatus and method for controlling the apparatus may be provided, which allows whether or not the auxiliary-drum is mounted to be determined automatically via rotation of the main-drum when the user closes the door of the laundry treating apparatus and inputs the start input, thereby to ensure safeness and prevent misuse.

In accordance with one embodiment of the present disclosure, the laundry treating apparatus and method for controlling the apparatus may be provided, which automatically determine whether the user has entered auxiliary washing and whether the auxiliary-drum is installed, thus, to minimize the user's actions, and automatically perform one of the general washing mode, the auxiliary washing mode and the simultaneous washing mode.

In accordance with one embodiment of the present disclosure, the laundry treating apparatus and method for controlling the apparatus may be provided, which can eliminate the inaccuracy of the sensed auxiliary laundry quantity due to the water initially contained in the auxiliary-drum and implement an optimum washing effect via the auxiliary-drum.

In accordance with one embodiment of the present disclosure, the laundry treatment apparatus and method for controlling the apparatus may be provided, which can remove inaccuracies in the sensed main laundry quantity caused by the water contained in the auxiliary-drum when detecting the main laundry quantity contained in the main-drum by rotating the main-drum, and implement an optimal washing effect via the main-drum.

In accordance with one embodiment of the present disclosure, the laundry treating apparatus and method for controlling the apparatus may be provided, which can more accurately detect a laundry quantity in the auxiliary washing or simultaneous washing and can perform optimal washing based on the sensed laundry quantity.

In accordance with one embodiment of the present disclosure, the laundry treating apparatus and method for controlling the apparatus, may be provided, which effectively detects the laundry quantity stored in the auxiliary-drum, to allow optimum washing by the auxiliary-drum.

In accordance with one embodiment of the present disclosure, the laundry treating apparatus and method for controlling the apparatus, may be provided, which allows optimal washing via applying different quantities of water supply according to the laundry quantity accommodated in the auxiliary-drum.

In accordance with one embodiment of the present disclosure, the laundry treating apparatus and method for controlling the apparatus may be provided, in which in the case of simultaneous washing, the laundry quantity detection in the main-drum and the laundry quantity detection in the auxiliary-drum are individualized, to allow effectively detecting each laundry quantity in each drum, which allows the optimal washing by the main-drum and auxiliary-drum.

DETAILED DESCRIPTION

Example of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims. In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure. For simplicity and clarity of illustration, elements in the figures are not necessarily drawn to scale. The same reference numbers in different figures denote the same or similar elements, and as such perform similar functionality.

The laundry treating apparatus according to one embodiment of the present disclosure will be described in detail with reference to the accompanying drawings.

Figure 1:
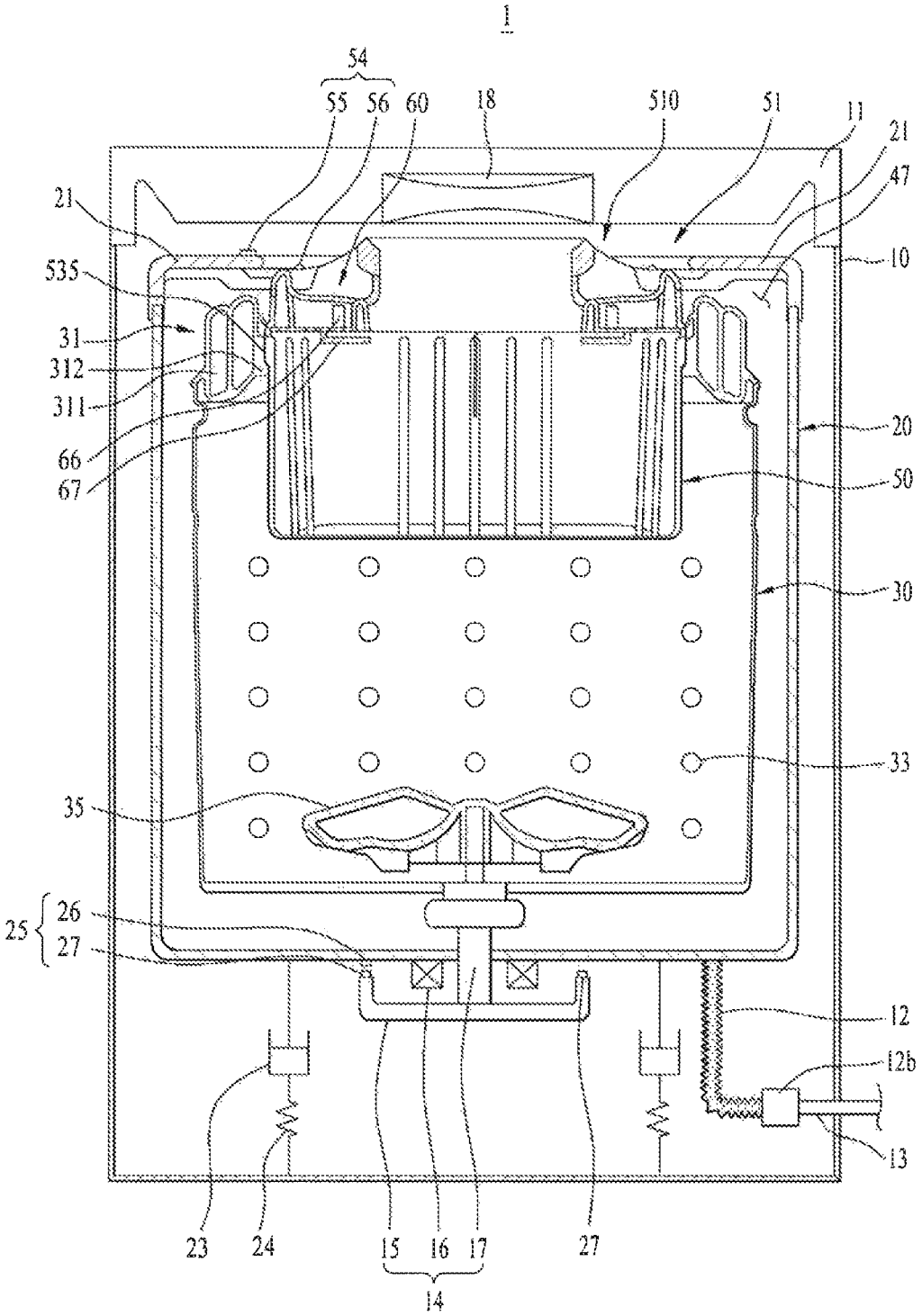
FIG. 1 is a schematic cross-sectional view of a configuration of a laundry treating apparatus according to one embodiment of the present disclosure.

FIG. 1 is a schematic cross-sectional view of the configuration of the laundry treating apparatus 1 according to one embodiment of the present disclosure.

Referring to FIG. 1, the laundry treating apparatus 1 according to one embodiment of the present disclosure may include a cabinet 10 having a top opening formed therein for loading the laundry, a tub 20 which is installed inside the cabinet 10 to store the washing water, and, a main-drum 30, which is installed in the tub 20 and generates driving force. Laundry may be received in the main-drum 30 may be washed therein.

In order to wash laundry, a pulsator 35 for generating the flow of the washing water may be provided under the drum. The pulsator 35 may be rotated integrally with the main-drum 30 or separately therewith. A drive unit 14 for generating the rotation of the drum and the rotational force of the pulsator may be provided.

Basically, the configuration of the laundry treating apparatus 1 according to one embodiment of the present disclosure may be the same or similar to the conventional laundry treating apparatus. However, in one embodiment of the present disclosure, the apparatus 1 may further include an auxiliary-drum 50 detachably mounted in and to the main-drum 30.

The auxiliary-drum 50 forms a washing space separate from the washing space of the main-drum 30.

FIG. 1 shows a direct drive structure in which the motor is directly connected to a rotation shaft 17 to drive the main-drum 30. The laundry treating apparatus 1 according to one embodiment of the present disclosure is not necessarily limited thereto.

The cabinet 10 forms the appearance of the laundry treating apparatus 1. The cabinet 10 includes a cabinet cover 11 with an opening for communicating the interior and exterior of the cabinet 10 for input of the laundry.

The cabinet cover 11 may be provided on the top of the cabinet 10, and the cabinet cover 11 may be selectively exposed by a door not shown. Accordingly, an operator, such as a user, may open the door and expose the cabinet cover 11 to the outside. The user may insert the laundry into the main-drum 30 and the auxiliary-drum 50 through the opening formed in the cabinet cover 11. Otherwise, the user may withdraw the laundry from within main-drum 30 and auxiliary-drum 50.

In one embodiment, a water supply 18 is provided in the cabinet cover 11 to supply clean water not containing detergent, or water containing detergent to the main-drum 30 and the auxiliary-drum 50. The water supply 18 selectively supplies the washing water supplied from the outside to the main-drum 30 or to the auxiliary-drum 50 through the inside of the tub 20 according to the rotation of the tub 20 to be described later.

In the present specification, the washing water includes a rinsing water for performing the rinsing cycle as well as the washing water for performing the washing cycle.

The tub 20 has an upper open cylindrical shape, and is formed to receive the washing water while being housed in the cabinet 10. The tub 20 includes the tub cover 21, which is mounted on the top thereof.

In the tub cover 21, the laundry inlet is formed in a position corresponding to the opening of the cabinet 10 so that the main-drum 30 and the auxiliary-drum 50 communicate with the outside. When the main-drum 30 rotates to perform the washing process, the tub cover 21 may be configured to moves the washing water upwards-circulating along the inner circumferential surface of the tub 20 due to the centrifugal force due to the rotation of the main-drum 30 to the central portion of the main-drum 30 and then to guide the water to drop into the main-drum 30.

The lower face of the tub 20 is elastically supported by a spring 24 and a damper 23 installed inside the cabinet 10. Further, since the lower face of the tub 20 is directly supported by the spring 24 and the damper 23, the tub cannot rotate itself. Thus, unlike the main-drum 30, the tub 20 does not receive a separate rotational force from the drive unit 14.

In FIG. 1, the configuration in which the spring 24 and the damper 23 are connected in series manner to the lower face of the tub 20 is shown, but the present invention is not limited thereto. The spring 24 and the damper 23 may be connected in parallel manner thereto, if necessary. The damper 23 may be connected to the lower face of the tub 20, while the spring 24 may be connected to the upper surface of the tub 20. The opposite is also possible.

Further, a water discharge device is connected to the lower face of the tub 20 to discharge water. The water discharge device includes a water discharge pump 12*b* that provides power to discharge the washing water contained in the tub 20, a first water discharge pipe 12 for guiding the washing water accommodated in the tub 20 to the water discharge pump 12*b* while one end thereof is connected to the lower side of the turbocharger and the other end thereof is connected to the water discharge pump 12*b*, and a second water discharge pipe 13 for discharging the washing water from the water discharge pump 12*b* to the outside of the cabinet 10 while one end thereof is connected to the water discharge pump 12*b* and the other end thereof is connected to one side of the cabinet 10. The first water discharge pipe 12 may be formed as a bellows pipe so that the vibration of the tub 20 is not transmitted to the water discharge pump 12*b*.

The drive unit 14 includes a motor consisting of a rotor 15 and a stator 16 and a rotation shaft 17 connected to the rotor 15. A clutch (not shown) is provided inside the driving unit, so that the driving force can be transmitted to the main-drum 30 and the pulsator 35. For example, when the drive unit 14 is selectively coupled to the main-drum 30 while the rotation shaft 17 is fixed to the pulsator 35, the drive unit 14 may transmit driving force to the pulsator 35 or drive force to the pulsator 35 and the main-drum 30 at the same time., In another example, when the drive unit 14 is selectively coupled to the pulsator 35 while the rotation shaft 17 is fixed to the main-drum 30, the drive unit 14 may transmit a driving force to the main-drum 30 30 or a driving force to the pulsator 35 and the main-drum 30 at the same time.

The configuration in which the drive unit is selectively coupled to the other of the pulsator 35 and the main-drum 30 while the rotation shaft 17 is fixed to one of the pulsator 35 or the main-drum 30 has been described. However, this description does not exclude a structure in which the rotation shaft 17 is selectively coupled to only one of the pulsator 35 and the main-drum 30.

The laundry treating apparatus 1 according to one embodiment of the present disclosure includes a main-drum 30 configured to be rotatably disposed within the tub 20 and to receive the laundry therein, and an auxiliary-drum 50, which is configured be detachable to the main-drum 39 and disposed in the main-drum.

The main-drum 30 is formed into a cylindrical shape having an open top and a generally circular cross-section. The lower face of the main-drum is directly connected to the rotation shaft 17 to receive rotational force from the drive unit 14.

The upper portion of the main-drum 30 is formed into an open cylindrical shape. A plurality of through-holes 33 are formed in the sidewall of the main-drum, that is, the circumferential surface portion. The main-drum 30 communicates with the tub 20 through a plurality of through-holes 33. Accordingly, when the washing water is supplied to the tub 20 at a certain level or higher in the tub, the main-drum 30 is submerged in the washing water, and, then, a portion of the washing water is injected into the main-drum 30 through the holes 33.

The main-drum 30 includes a drum-cover 31 provided on its top. The drum-covers 31 is formed in the shape of a ring having a hollow and is disposed below the tub cover 21.

In one embodiment, a water discharge channel 47 may be defined by the drum-cover 31 and the tub cover 21. That is, the water discharge channel 47 may be defined as a space formed between the drum-cover 31 and the tub cover 21. The water discharge channel 47 guides the washing water discharged from the inside of the auxiliary-drum 50 to the outside of the auxiliary-drum 50 through the top of the auxiliary-drum 50 into the inside of the tub 20.

The water discharge channel 47 may prevent the washing water discharged from the auxiliary-drum 50 from flowing into the main-drum 30. Thus, the washing water discharge path from the main-drum 30 and the washing water discharge path from the auxiliary-drum 50 may be configured independently of each other.

In the drum-cover 31, an opening is formed in which the laundry may be inserted or the auxiliary-drum 50 may be mounted. Further, inside the drum-cover 31, there is provided a balancer 311 which eliminates the imbalance caused by the laundry biasing in the main-drum 30. In this case, the water discharge channel 47 may be defined to include a space formed between the balancer 311 and the tub cover 21.

The laundry treating apparatus according to one embodiment of the present disclosure includes a first sensor unit 54, a second sensor unit 25, a control unit 100, and a brake unit 110 for braking the rotation of the main-drum 30.

The auxiliary-drum 50 rotates integrally with the main-drum 30, so that the position of the auxiliary-drum 50 can be controlled by controlling the rotation of the main-drum. Position control of the auxiliary-drum 50 may mean that the drum is controlled such that the specific portion or region of the auxiliary-drum 50 is located at a specific rotational position. That is, the position control of the auxiliary-drum may mean that the drum is controlled such that the specific portion or region of the auxiliary-drum stops at a specific angle. The position control of the auxiliary-drum may be performed to accurately supply the water to the auxiliary-drum or the main-drum. The position control of the auxiliary-drum may be performed such that the handle is positioned at a predetermined position. The user may hold the handle of the auxiliary-drum and apply a force to the handle to separate the auxiliary-drum from the main-drum. Therefore, the handle needs to be positioned at a predetermined position so that the user can easily apply the force in a comfortable posture.

The first sensor unit 54 may be configured to sense the rotational position of the auxiliary-drum 50. That is, the first sensor unit may be configured to sense whether the auxiliary-drum 50 is located at a rotation reference point out of a rotation reference point.

Further, the first sensor unit 54 may be configured to determine whether the auxiliary-drum 50 is mounted. That is, the first sensor unit may be configured to sense whether the auxiliary-drum 50 is mounted on the main-drum 30, properly mounted thereon or detached therefrom.

The first sensor unit 54 may be configured to control the position of the auxiliary-drum 50. The auxiliary-drum 50 may have a specific shape as will be described later. Further, as will be described later, it is necessary that the relationship between the water supply point for supplying the washing water and the location of the auxiliary-drum 50 be specified. For this reason, it is necessary to detect the position of the auxiliary-drum 50 and perform the position control of the drum 50.

In one example, the first sensor unit 54 may include a first Hall sensor 55 and a first magnet 56. The first Hall sensor 55 may be provided in the tub 20, and the first magnet 56 may be provided in the auxiliary-drum 50. The first Hall sensor 55 and the first magnet 56 may be positioned to face each other at a rotation reference point of the auxiliary-drum 50. Thus, the first Hall sensor 55 is fixed to the tub 20, and, hence, the position of the sensor 55 is fixed. The first magnet 56 may be rotated together with the auxiliary-drum 50.

Specifically, the first Hall sensor 55 may be provided on the top face of the tub 20 cover or on the inner edge face of the cover of the tub 20. The first magnet 56 may be installed on the top face of the auxiliary-drum 50 at the edge side thereof such that the first magnet be sensed by the first Hall sensor 55. Accordingly, when the auxiliary-drum 50 rotates, the first Hall sensor 54 senses the first magnet 56 and sends a sensing signal to the control unit 100.

When the first sensor unit 54 senses that the auxiliary-drum 50 is located at a position out of 90 degrees in a counterclockwise from the reference point, the control unit 100 controls the drive unit 14 to rotate the auxiliary-drum 50 clockwise by 90 degrees and to stop the rotation. Since the auxiliary-drum 50 rotates integrally with the main-drum 30, the clockwise rotation may be accomplished by the drive unit 14 rotating the main-drum 30 clockwise by 90 degrees. The control unit 100 preferably also controls, via the more precise position, control the brake unit 110 together with the drive unit 14.

The second sensor unit 25 may be configured to sense the rotational position of the main-drum 30. That is, the second sensor unit may be configured to detect whether the main-drum 30 is located at a rotation reference point or out of a rotation reference point.

The main-drum 30 may rotate in synchronization with the rotor 15. That is, the rotation angle of the main-drum 30 and the rotation angle of the rotor 15 may be the same.

In one example, the second sensor unit 25 may include a second Hall sensor Hall sensor 26, and a second magnet 27. The second Hall sensor 26 may be provided in the tub 20 and a second magnet 27 may be provided in the rotor 15. The second Hall sensor 26 and the second magnet 27 may be positioned to face each other at a rotation reference point of the main-drum 30. Thus, the second Hall sensor 26 is fixed to the tub 20, and, thereby, the position of the second sensor is fixed. The second magnet 27 may be rotated together with the rotor 15.

Specifically, the second Hall sensor 26 is provided below the lower face of the tub 20. The second magnet 27 is detected by the second Hall sensor 26. To this end, the second magnet may also be provided on the top face of the rotor 15. The second Hall sensor 26 may be a single hall sensor. A plurality of the second magnets 27 may be arranged along the outer circumference of the rotor. Thus, when the main-drum 30 rotates, the second Hall sensor 26 senses the angle of rotation of the main-drum 30 and sends a sensing signal to the control unit 100. In other that the second sensor unit 25 senses the correct angle of rotation of the main-drum 30, the magnets of the second magnet 27 are provided in the rotor 15 at equal intervals. Further, as the number of the magnets provided increases, the rotation angle of the main-drum 30 can be precisely detected. That is, the rotation angle of the rotor 15 may be sensed by the second sensor unit 25. Then, the rotation angle of the main-drum 30 may be determined based on the sensed rotation angle.

In one embodiment, the rotation angle of the rotor 15 may be sensed without a separate sensor. That is, the rotation angle of the main-drum 30 can be determined by sensing the rotation angle of the rotor 15 in a sensorless manner without a sensor. In this sensorless method, after a phase current of a constant frequency flows through the motor, the rotor position of the motor is estimated based on the output current detected while the current of the constant frequency flows through the motor. Thus, the position of the rotor 15 can be estimated. Such a sensorless method may be a known technology, and thus a detailed description thereof will be omitted.

The position control of the auxiliary-drum 50 may be started after the first sensor unit 54 determines whether or not the auxiliary-drum 50 is mounted and it is determined from the determination result that the auxiliary-drum 50 is mounted. For example, the first sensor unit 54 may determine whether the auxiliary-drum 50 is mounted by rotating the auxiliary-drum 50 by 360 degrees or larger. If no sensing signal is generated from the first sensor unit 54, it may be determined that the auxiliary-drum 50 is not mounted. When a detection signal is generated from the first sensor unit 54, it may be determined that the auxiliary-drum 50 is mounted.

Thereafter, the auxiliary-drum 50 may be rotated by a predetermined rotation angle from the position of the auxiliary-drum 50 as determined when the auxiliary-drum is mounted. In this connection, the auxiliary-drum 50 may be rotated such that an arbitrary point of the auxiliary-drum 50 is positioned at a predetermined point outside the auxiliary-drum 50.

Any point of the auxiliary-drum 50 may be a specific position of the auxiliary-drum 50, where an inner water-supply guide 560 and an outer water-supply guide 570 as will be mentioned layer are located. Further, the predetermined point outside the auxiliary-drum 50 may be located below the water supply 18. In this connection, the rotation angle of the auxiliary-drum 50 is measured in a manner using the second sensor unit 25 or in a sensorless manner without a sensor. This may be feasible because the auxiliary-drum 50 and the main-drum 30 rotate integrally.

The position control of the auxiliary-drum 50 may be used during water supply. In one example, while the inner water-supply guide 560 is placed under a single water supply 18, the washing water may be supplied to the auxiliary-drum 50 through the inner water-supply guide 560. In this connection, the washing water may be supplied to the auxiliary-drum 50 through the water supply 18.

Thereafter, while the auxiliary-drum is rotated to place the outer water-supply guide 570 under the single water supply 18, the washing water may be supplied to the main-drum 30 via the outer water-supply guide 570. In this connection, the washing water may be supplied to the main-drum 50 through the water supply 18.

The washing water supplies into the main-drum 30 and the auxiliary-drum 30 may be independently performed via the auxiliary-drum position control and the water supply as described above. That is, the washing water supplied to the main-drum 30 and the washing water supplied to the auxiliary-drum 50 may be spatially separated from each other. During the watering process, the washing water, which is supplied to the auxiliary-drum 50, does not flow into the main-drum 30 or vice versa.

Hereinafter, the auxiliary-drum 50 will be described in detail with reference to FIGS. 3 to 4.

Figure 2:
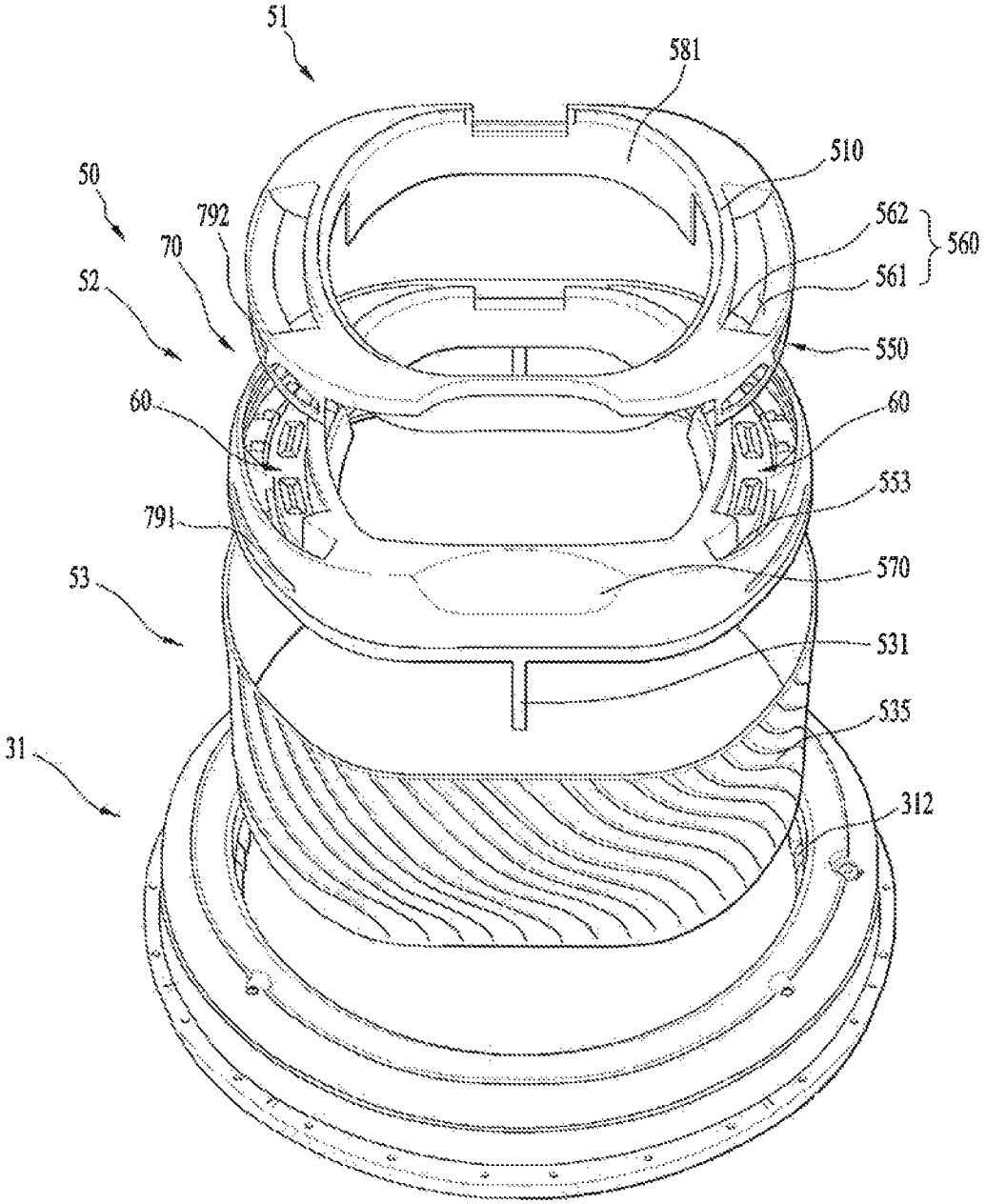
FIG. 2 is an exploded perspective view of an auxiliary-drum shown in FIG. 1.

FIG. 2 is an exploded perspective view of the auxiliary-drum 50 shown in FIG. 1. FIG. 3 is a cross-sectional view of the auxiliary-drum 50 shown in FIG. 1. FIG. 4 is a top view of the auxiliary-drum 50 mounted on the main-drum 30.

Figure 3:
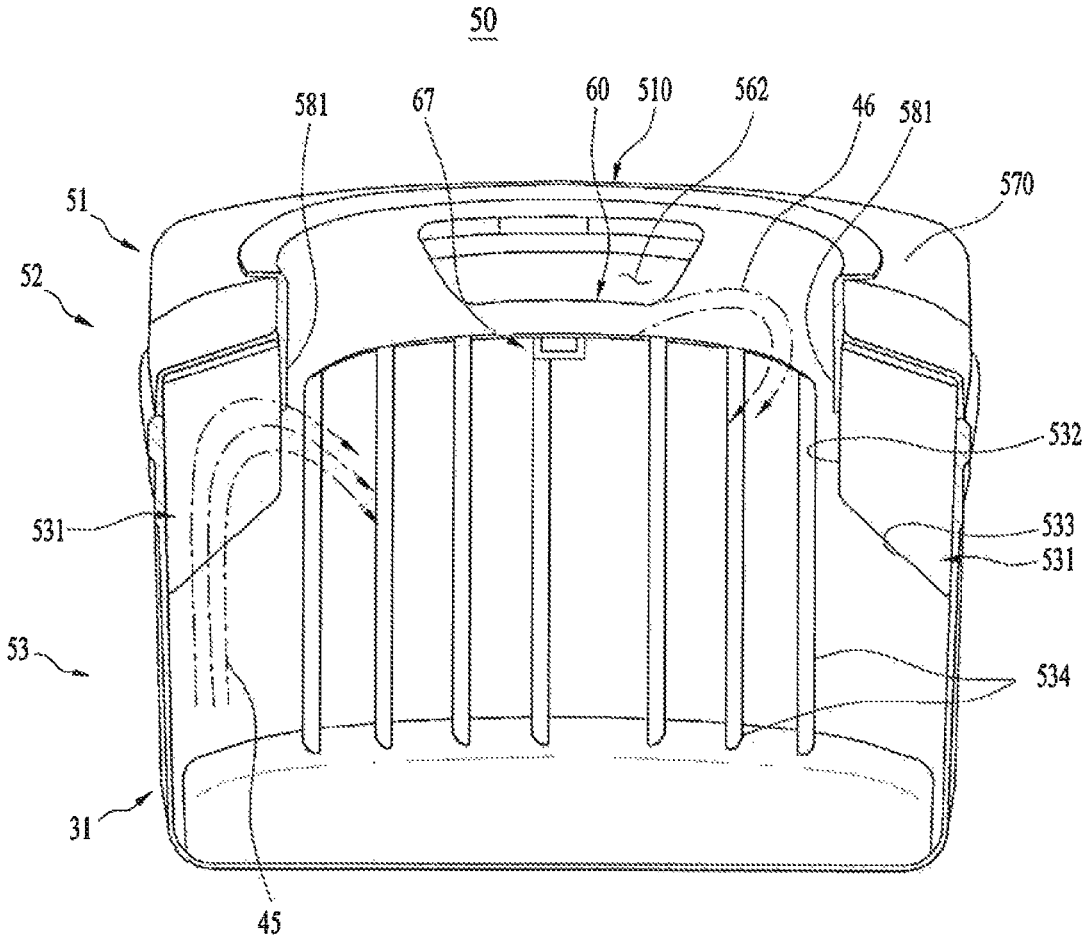
FIG. 3 is a cross-sectional view of an auxiliary-drum.
Figure 4:
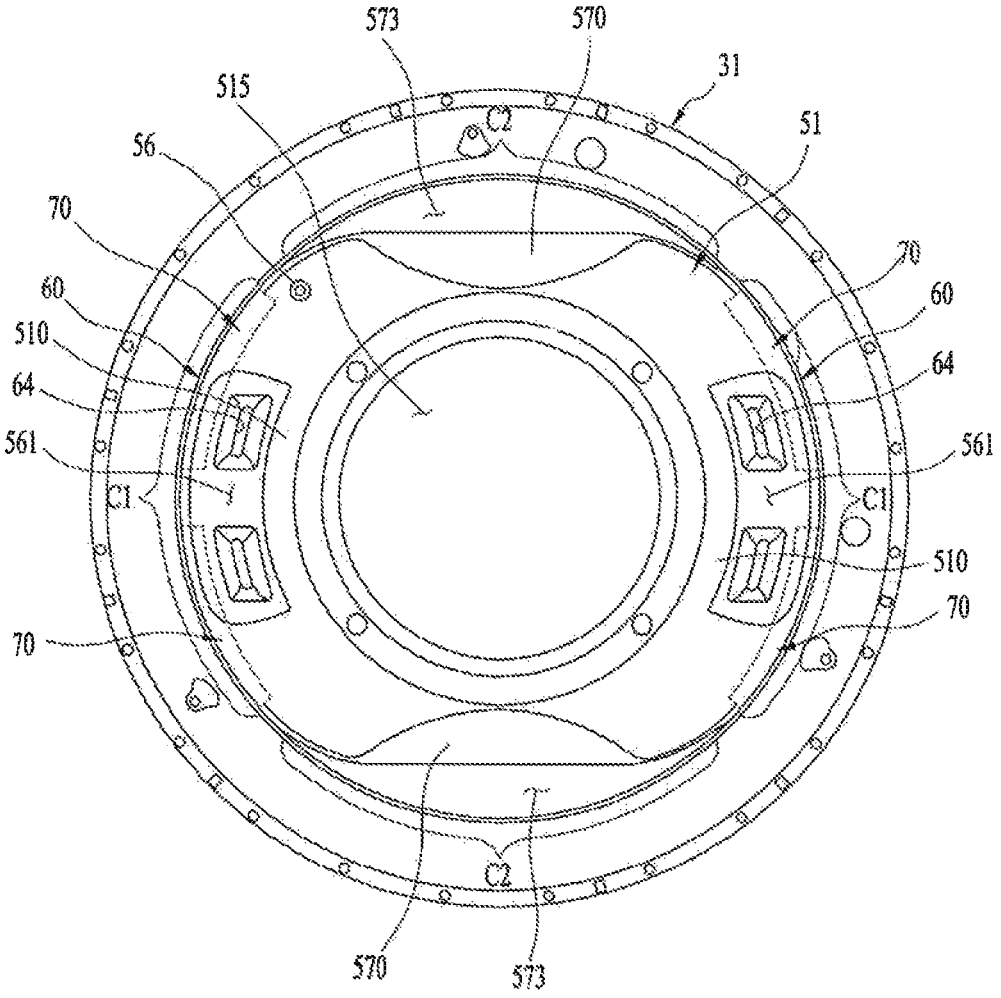
FIG. 4 is a top view of an auxiliary-drum mounted on a drum.

Referring to FIG. 2 to FIG. 4, the auxiliary-drum 50 is configured to be detachable inside the main-drum 30. Further, the auxiliary-drum 50 is separated from the main-drum 30. The laundry and the washing water may be accommodated in the auxiliary-drum to perform washing therein. Accordingly, the auxiliary-drum and the main-drum are distinguished from each other depending on the color or material thereof. After the laundry that needs washing is put into the main-drum 30 and the auxiliary-drum 50 in a manner distinct from each other. At different times, washing of the distinct laundries may be performed in the auxiliary and main-drums. Alternatively, at the same time as each other, washing of the separated laundries may be performed in the auxiliary and main-drums. As the number of operations of the laundry treating apparatus 1 decreases, the washing water, detergent and energy can also be saved.

Further, while the auxiliary-drum 50 is disposed in the inside the main-drum 30 and coupled thereto, the auxiliary-drum receives rotational force from the main-drum 30 such that the auxiliary-drum performs washing. Thus, there is no need for a separate driving device for the auxiliary-drum.

The auxiliary-drum 50 has the following horizontal cross-section shape to form the vortex of the washing water. The horizontal cross-section may have a shape that is not circular but extends in one direction in a larger dimension and extends in another direction across said one direction in a shorter dimension. Therefore, a portion of the outer circumferential surface of the auxiliary-drum 50 may be coupled to the inner circumferential surface of the main-drum 30, while the remainder of the outer circumferential surface thereof may be spaced from the inner circumferential surface of the main-drum 30.

For example, the horizontal cross-section of the auxiliary-drum 50 may be approximately elliptical. A portion of the periphery of the horizontal cross-section of the auxiliary-drum 50 may be curved to face-contact the inner circumferential surface of the main-drum 30, while the remainder of the periphery of the horizontal cross-section may be spaced from the inner circumferential surface of the main-drum 30 and may be formed in a straight line. In one example, the horizontal cross-section of the auxiliary-drum 50 may be formed about in a track shape.

Accordingly, in this embodiment, vortex is generated more effectively by rotation than when the horizontal cross-section of the auxiliary-drum 50 is formed in a circular shape. As the vortex increases the friction between the washing water and the laundry, or the friction between the laundries, the washing force in this embodiment is increased compared to when the horizontal cross-section of the auxiliary-drum 50 is circular.

Further, the auxiliary-drum 50 may include a friction rib 534 protruding from the inner circumferential face to form a vortex of the washing water.

In one embodiment, the inner circumferential face of the auxiliary-drum 50 may be divided into a first curvature portion C1 formed to have a first curvature and a second curvature portion C2 formed to have a second curvature smaller than the first curvature.

A pair of first curvature portions C1 are defined at opposite positions of the auxiliary-drum body 53, respectively. The first curvature is formed to coincide with the curvature of the inner circumferential face of the opening formed in the drum-cover 31. Therefore, the first curvature portion C1 of the auxiliary-drum may be inserted into the main-drum so as to be in contact with the inner circumferential surface of the main-drum in a conformed manner.

A pair of second curvature portions C2 are defined at opposite positions of the auxiliary-drum body 53 respectively. Between a pair of the first curvature portions C1, each second curvature portion of the pair of second curvature portions C2 is disposed. The second curvature is formed to be smaller than the first curvature. Therefore, the second curvature portion C2 of the auxiliary-drum may be inserted into the main-drum to be spaced apart from the main-drum.

That is, the first curvature portion C 1 and the second curvature portion C2 are alternately repeatedly arranged along the circumference of the horizontal cross-section of the auxiliary-drum body 53.

This curvature portions may be described as follows.

The inner circumferential face of the auxiliary-drum 50 may include a smaller spacing portion C2 spaced a first distance from the rotation center of the auxiliary-drum 50, and a larger spacing portion C1 spaced by a second distance greater than the first distance from the rotation center of the auxiliary-drum 50. In this case, the smaller spacing portion C2 may be formed in a plane, while the larger spacing portion C1 may be curved so as to be in contact with the inner circumferential face of the main-drum 30. Alternatively, both the larger spacing portion C1 and the smaller spacing portion C2 may be curved. In this case, the larger spacing portion C1 corresponds to the first curvature portion C1, while the smaller spacing portion C2 corresponds to the second curvature portion C2.

In one embodiment, the smaller spacing portion C2 and the inner circumferential face of the drum-cover 31 are spaced apart from each other by a sufficient distance. Thus, a first water-supply channel 573 to be described later is formed.

The first curvature portion C 1, the second curvature portion C 2, the larger spacing portion C 1, the smaller spacing portion C 2, the contact portion C 1 and the spaced portion C 2 in this specification indicate the specific region of the auxiliary-drum 50. When a specific region is included in the specific region of the auxiliary-drum 50, the specific region may be named using the above terms blow.

Holes 33 are not provided in the circumferential face of the auxiliary-drum 50, unlike the case in which the through-holes 33 are provided in the circumferential face of the main-drum 30. Thus, the auxiliary-drum body 53 may accommodate the washing water and the laundry therein. The washing water is not discharged into the main-drum 30 through the circumferential face or the lower face. Thus, the washing water contained in the tub 20 is only injected into the main-drum 30 through the through-hole 33. Even when the auxiliary-drum 50 is submerged in the washing water contained within the tub 20, the washing water is not injected into the auxiliary-drum.

The friction ribs 534 protrude from the inner circumferential face of the auxiliary-drum 50 and extend up and down. The plurality of friction ribs 534 are spaced apart at regular intervals. The ribs may be formed integrally with the auxiliary-drum 50. During the rotation of the auxiliary-drum 50, the washing water is rotated in the direction of rotation of the auxiliary-drum 50 by the friction force between the washing water and the friction rib 534. The friction rib 534 is different in shape and function from a guide rib 531 to be described later.

In one embodiment, the auxiliary-drum 50 may include a laundry receiving opening 515 formed in the top face for the laundry input therein, and a coupled guide 581 formed along the inner circumferential face of the laundry receiving opening 515. The auxiliary-drum further includes a handle portion 510 that provides a space for the user to grip. Accordingly, the user may use the handle portion 510 to attach/detach the auxiliary-drum 50 to/from the main-drum.

The auxiliary-drum 50 may further include an inner water-supply guide 560 for guiding the washing water discharged from the water supply 18 to the inside of the auxiliary-drum 50. Further, the auxiliary-drum 50 may include an outer water-supply guide 570 for guiding the washing water discharged from the water supply 18 to the inside of the main-drum 30 through the outside of the auxiliary-drum 50. The outer water-supply guide 570 may have a downwardly curved shape. The guide 570 may guide the falling washing water to flow smoothly downward into the main-drum 30.

The auxiliary-drum 50 may include a guide rib 531 for forming a strong water-flow of the washing water. The guide rib 531 may be configured such that the washing water circulating along the inner circumferential face of the auxiliary-drum 50 changes its direction of flow by the collision with the rib 531 and is pulled upwards to a top and then falls from the top to the center of the auxiliary-drum 50. Therefore, the guide rib 531 may form a water-flow like waterfall falling from the top to the bottom, thereby improving the washing effect.

A pair of handle portions 510 are formed on the top face of the auxiliary-drum 50. Specifically, the handle portion 510 is formed in the shape of bar. Both ends of the bar are engaged with the top face of the auxiliary-drum 50. The handle portion 510 may be formed integrally with the auxiliary-drum 50.

In one embodiment, the handle portion 510 is provided adjacent the first curvature portion C1 of the auxiliary-drum 50, i.e., the larger spacing portion C1. The impact occurring in separating the auxiliary-drum 50 from the main-drum 30 may cause the washing water to be biased toward one of the pair of larger spacing portions C1. In this case, the auxiliary-drum 50 may easily rotate about a virtual axis passing through a pair of the smaller spacing portions C2 so that the washing water inside may spill out. For this reason, the position of the handle portion 510 is important.

In one example, when the handle portion 510 is provided adjacent to the second curvature portion C2, i.e., the smaller spacing portion C2, the user has to apply a lot of force to prevent the rotation of the auxiliary-drum 50. For this reason, the handle portion 510 is advantageously provided adjacent to the larger spacing portion C1.

The inner water-supply guide 560 is provided in the top face of the auxiliary-drum 50. The guide 560 is provided adjacent to the larger spacing portion C1, i.e., the contact portion C1. The inner water-supply guide 560 includes a recess 561 and a water-supply hole 562.

The recess 561 is formed by recessing a part of the top face of the auxiliary-drum 50 so that when the washing water discharged from the water supply 18 collides with the top face of the auxiliary-drum 50, the water does not scatter around the top face of the auxiliary-drum 50.

The water-supply hole 562 is formed on the inner face of the recess 561 with facing the laundry receiving opening 515. The hole 562 may be formed to communicate the laundry receiving opening 515 and the recess 561.

Thus, as the washing water is guided from the recess 561 through the water-supply hole 562 to the laundry receiving opening 515, the recess 561 and the water-supply hole 562 form a second water-supply channel 560 that guides the washing water to the auxiliary-drum 50. The washing water discharged from the water supply 18 is temporarily stored in the recess 561 so that it is not scattered around the auxiliary-drum 50. Thereafter, the wash water is discharged through the water-supply hole 562, i.e., the second water-supply channel 560, into the laundry receiving opening 515 and then into the auxiliary-drum 50.

In one embodiment, the recess 561 and the water-supply hole 562 are formed under the handle portion 510. This maximizes the space efficiency of the auxiliary-drum 50.

The outer water-supply guide 570 is provided at the edge of the top face of the auxiliary-drum 50. The guide 570 is provided adjacent to the smaller spacing portion C2, that is, the spaced portion C2. The outer water-supply guide 570 is spaced from the inner water-supply guide 560. The auxiliary-drum 50 rotates with the main-drum 30 by a predetermined angle such that each of the inner water-supply guide 560 and the outer water-supply guide 570 is positioned below the single water supply 18. Therefore, although the outer water-supply guide 570 is provided separately from the inner water-supply guide 560, the washing water discharged from the single water supply 18 may be supplied to the main-drum 30 and the auxiliary-drum 50, respectively.

The outer water-supply guide 570 may be formed by recessing the edge of the top face of the auxiliary-drum 50, that is, the edge portion of the spaced portion C2 toward the inside of the auxiliary-drum 50. Accordingly, the auxiliary-drum 50 is provided with the outer water-supply guide 570 composed of an outwardly and downwardly sloping face. When the washing water is discharged from the water supply 18, the washing water is guided to the inside of the main-drum 30 through the first water-supply channel 573 defined as a space formed between the spaced portion C2 and the inner peripheral surface of the main-drum 30.

The guide rib 531 is formed in a plate shape and is provided below the top face of the auxiliary-drum 50 and extends downward. Further, the guide rib 531 is provided such that one side thereof contacts the inner circumferential face of the auxiliary-drum 50. In other words, the plate-shaped guide rib 531 has its upper side engaged with the auxiliary-drum 50 cover and its one side contacting the inner circumferential face of the auxiliary-drum 50. Accordingly, the washing water inside the auxiliary-drum 50 may be rotated along the inner circumferential face of the auxiliary-drum 50 by the rotational force of the auxiliary-drum 50, and, then, the washing water may flow upward due to the collision with the guide rib 531, and, then, the washing water may drop along a parabolic curve toward the center of the auxiliary-drum 50.

Specifically, the guide rib 531 includes a rib vertical portion 532 formed on one side face toward the center of the auxiliary-drum 50 and extending downward from the top face of the auxiliary-drum 50, and a rib-inclined portion 533 formed on the bottom face toward the bottom of the auxiliary-drum 50, wherein the portion 533 extends from the rib vertical portion 532 downwardly toward the inner circumferential face from the center of the auxiliary-drum 50.

The rib inclined portion 533 forms an acute angle with the inner circumferential face of the auxiliary-drum 50. The portion 533 is formed to be spaced apart from the lower face of the auxiliary-drum 50.

As the rib-inclined portion 533 is formed on the bottom face of the guide rib 531, the laundry that rotates with the washing water inside the auxiliary-drum 50 is less interfered. Thus, the laundry flows more smoothly. This may increase the friction between the laundries and, thus, increase the washing power.

In one embodiment, even when the guide rib 531 includes the rib-inclined portion 533, a sufficient amount of the washing water may be elevated. For example, when the auxiliary-drum 50 rotates at high speed, the water level of the washing water on the inner circumferential face of the auxiliary-drum 50 is higher than the water level of the washing water in the center of the auxiliary-drum 50. Therefore, even when the rib-inclined portion 533 is formed on the guide rib 531, the sufficient amount of the washing water may rise up via colliding against the guide rib 531.

In one embodiment, when the auxiliary-drum 50 rotates at a relatively low speed, a sufficient amount of the washing water can be raised up by placing the guide rib 531 in the smaller spacing portion C2 of the auxiliary-drum 50. The amount of the washing water passing through the imaginary cross section from the center of the auxiliary-drum 50 to the smaller spacing portion C2 may be equal to the amount of washing water passing through the imaginary cross-section from the center of the auxiliary-drum 50 to the larger spacing portion C1.

Thus, the height of the washing water is higher when the wash water passes through an imaginary cross-section from the center of the auxiliary-drum 50 to the smaller spacing portion C2 than when the wash water passes through the imaginary cross-section from the center of the auxiliary-drum 50 to the larger spacing portion C1. Thus, even when the auxiliary-drum 50 rotates at a relatively low speed, the guide rib 531 may lift up the sufficient amount of the washing water.

Further, one face of the guide rib 531 where the guide rib collides with the washing water, and the other face located opposite said one face may be formed with an upward slope toward the direction of the washing water, respectively. That is, when the guide rib 531 is viewed along the radial direction from the center of the auxiliary-drum 50, the width of the lower cross-section thereof may be greater than the width of the upper cross-section thereof. Thus, the washing water may more easily rise up along the one face and the other face of the guide rib 531.

Each guide rib 531 is provided in each of the smaller spacing portions C2 as described above. That is, a pair of guide ribs has been described, but the present disclosure is not limited thereto. Each guide rib is further provided in each of the larger spacing portions C1. Thus, a total of two pairs of guide ribs may be formed. However, in this case, the laundry may not be easily moved inside the auxiliary-drum 50 due to excessive interference of the guide ribs 531.

In one embodiment, the structure for coupling between the auxiliary-drum 50 and main-drum 30 includes a convex-concave based coupling structure. This structure includes a first convex-concave portion 312 formed on the inner circumferential face of the main-drum 30 and a second convex-concave portion 535 formed on the outer circumferential surface of the auxiliary-drum and configured to engage the first convex-concave portion 312. When the drum-cover 31 is mounted on the top of the main-drum 30, the first convex-concave portion 312 may also be formed on the inner circumferential face of the drum-cover 31. Hereinafter, the case where the drum-cover 31 is mounted on the top of the main-drum 30 may be illustrated as an example.

The first convex-concave portion 312 protrudes from the inner circumferential face of the drum-cover 31. Further, on the top of the first convex-concave portion 312, protrusions protruding upward are formed continuously. This first convex-concave portion 312 is formed over the entire circumference of the inner circumferential face of the drum-cover 31.

The second convex-concave portion 535 protrudes from the outer circumferential face of the auxiliary-drum 50. However, since the outer circumferential face of the auxiliary-drum may be divided into the smaller spacing portion C2 and the larger spacing portion C1, and, in this case, the larger spacing portion may be coupled to the inner circumferential face of the drum-cover, the second convex-concave portion 535 may be formed in the larger spacing portion. On the bottom of the second convex-concave portion 535, protrusions protruding downward are formed continuously. The protrusions of the second convex-concave portion 535 engage the protrusions of the first convex-concave portion 312.

Thus, the rotational force of the main-drum 30 is transmitted to the auxiliary-drum 50. Accordingly, when the main-drum 30 rotates, the auxiliary-drum 50 may rotate together with the main-drum 30. In one embodiment, the auxiliary-drum 50 includes a water discharge structure 70 for discharging the washing water inside the drum 50 when the drum rotates at a high speed. Each water discharge structure 70 is provided adjacent to the first curvature portion C, i.e., the larger spacing portion C1. The water discharge structure selectively discharges the washing water accommodated in the auxiliary-drum 50 to the outside based on the magnitude of the centrifugal force due to the rotation of the auxiliary-drum 50.

As described above, the washing process by the auxiliary-drum 50 and the washing process by the main-drum 30 are separated from each other. To this end, the water-supply to the main-drum 30 and the water-supply to the auxiliary-drum 50 should be separated from each other. Further, during washing, the washing water supplied to the auxiliary-drum 50 should be received in the auxiliary-drum 50 so as not to flow into the main-drum 30. During the water discharge and spinning, the wash water must be discharged from the auxiliary-drum 50.

In other words, when the auxiliary-drum 50 is rotated at a washing RPM to perform washing, the washing water must be stored inside the auxiliary-drum 50. When the drum is rotated at a spinning RPM greater than the washing RPM to perform spinning, the washing water should be discharged from the auxiliary-drum 50.

In this connection, the water discharge structure 70 functions to discharge the washing water to the outside only when the centrifugal force generated by rotation of the auxiliary-drum 50 at the spinning RPM greater than the washing RPM acts on the washing water.

The water discharge structure 70 includes a chamber (not shown) in which the washing water is received, an inflow hole (not shown) through which the washing water is introduced into the chamber, and a discharge-hole 79 through which the water from the chamber is discharged.

In the water discharge structure 70, the inflow hole is provided in the lower face of the chamber. The inflow hole may be spaced a predetermined distance radially inward from the side wall of the auxiliary-drum 50. Accordingly, since the total area of the inflow hole is smaller than the area of the lower face of the chamber in which the washing water collides, a first flow resistance occurs when the washing water flows into the inflow hole. Then, a second flow resistance occurs. To overcome this resistance, the washing water which moves radially outwards and upwards due to the centrifugal force due to the rotation of the auxiliary-drum 50 must overcome the centrifugal force and thus move radially inwards.

Further, in the water discharge structure 70, the discharge-hole 791 is provided above the inflow hole. The discharge hole 791 passes through the side wall of the auxiliary-drum 50. Accordingly, when the washing water flows into the chamber through the inflow hole, a third tertiary resistance may further occur. To overcome this resistance, the washing water should move radially outward of the auxiliary-drum 50 and then overcome the gravity and rise up again.

Thus, when the auxiliary-drum 50 rotates at a washing RPM lower than the spinning RPM, the washing water is not discharged from the inside of the auxiliary-drum 50. That is, only when the auxiliary-drum 50 rotates in the predetermined spinning RPM band, the washing water is selectively discharged therefrom. In one embodiment, this selective discharge may be realized without components to be controlled, such as a water discharge valve or a water discharge pump.

In one embodiment, the auxiliary-drum 50 may include a body 53 for receiving the washing water and the laundry, and an auxiliary-cover coupling to the upper portion of the body 53. The auxiliary-cover has a receiving opening 515 for introducing the laundry into the body. In this case, the second convex-concave portion 535 may be provided on the outer circumferential face of the body 53. Otherwise, the weight of the washing water and the laundry stored in the body 53 may cause the auxiliary-cover to be separated from the body 53. For this reason, the second convex-concave portion 535 is required. Further, the water discharge structure 70, the guide rib 531, the handle portion 510, the inner water-supply guide 560 and the outer water-supply guide 570 may be formed in or on the auxiliary-cover.

In one embodiment, the auxiliary-cover may be formed integrally with the body. However, in another embodiment, as shown in FIG. 2, the auxiliary cover may include a lower cover 52 coupled to a top of the body 53 and an upper cover 51 coupled to an upper portion of the lower cover 52.

The chamber (not shown) of the water discharge structure 70 may be defined via coupling between the lower cover 52 and the upper cover 51. In this regard, the inflow hole is provided in the lower cover 52. The discharge-hole 79 includes a first discharge-hole 791 formed in the top of the lower cover 52 and a second discharge-hole 792 formed in the top of the upper cover 51. As a result, the washing water enters the chamber through the inflow hole and then is discharged through the discharge-hole 79 composed of the second discharge-hole 792 and the first discharge-hole 791.

The recess 561 forming the inner water-supply guide 560 is defined via the coupling of the lower cover 52 and the upper cover 51. The top face of the lower cover 52 forms the lower face of the recess 561, and the recessed portion of the upper cover 51 partially forms an inclined face of the recess 561. The water-supply hole 562 forming the inner water-supply guide 560 may be defined as the space between the handle portion 510 and the top face of the lower cover 52.

In one embodiment, the laundry treating apparatus 1 according to one embodiment of the present disclosure may carry out one or more washing courses. To this end, a separate control panel may also be provided in the apparatus 1 to allow the user to select the washing course. The control panel may include an input interface for allowing the user to input various washing courses, and a display unit for displaying the washing course as inputted.

This control panel includes a washing course for the laundry contained in the drum. However, a washing course for the laundry contained in the auxiliary-drum 50 may not be provided in the panel. In this case, the laundry treating apparatus 1 may be configured, when the auxiliary-drum 50 is mounted on the main-drum, to determine a washing course corresponding to the mounted auxiliary-drum 50 among a plurality of previously inputted washing courses, and to perform the determined course.

Accordingly, when the user wishes to use the auxiliary-drum 50 by mounting the auxiliary-drum 50 on the existing laundry treating apparatus 1 in which the auxiliary-drum 50 is not provided generally, the user may use the control panel of the laundry treating apparatus 1 without modification thereof.

Figure 5:
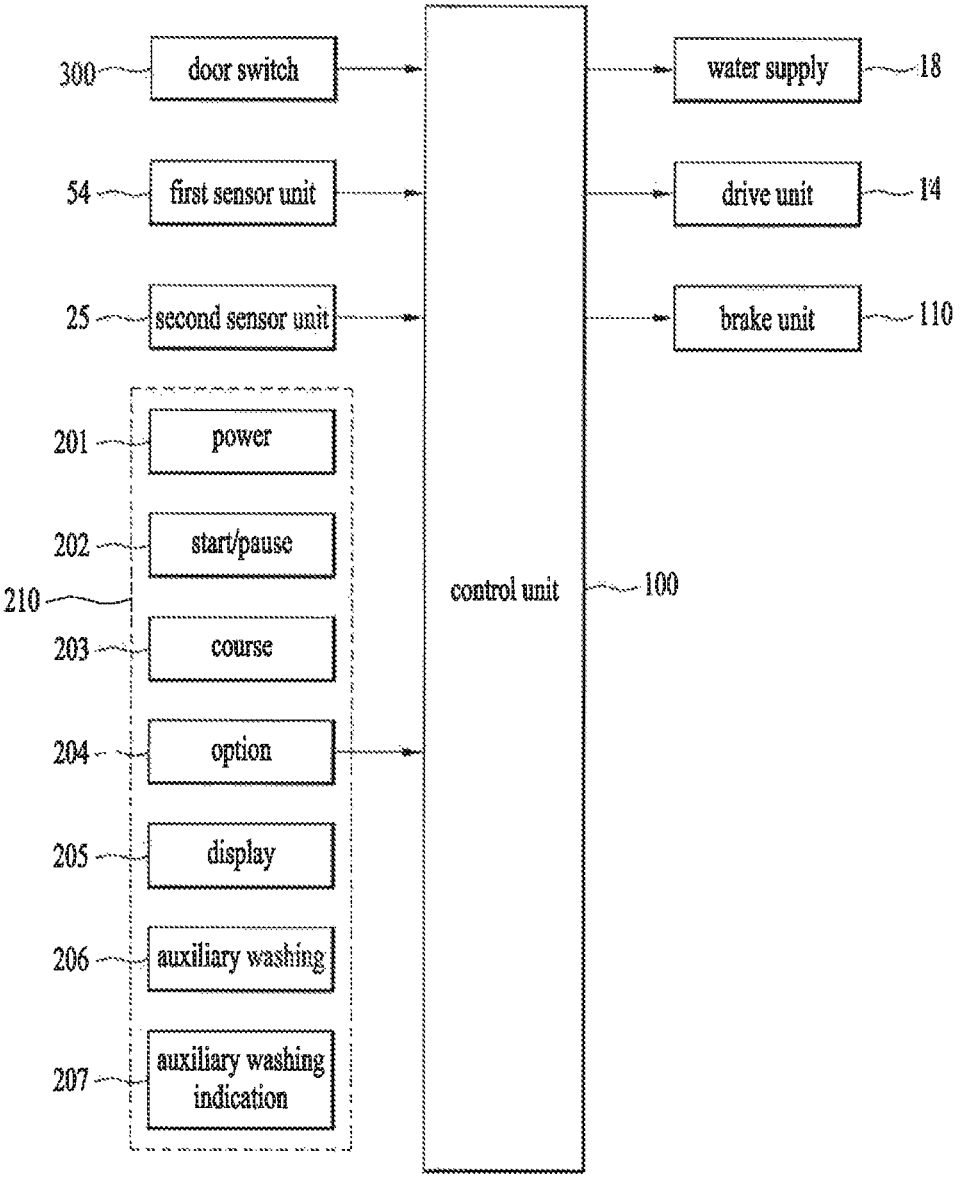
FIG. 5 is a block diagram showing a configuration of the laundry treating apparatus according to one embodiment of the present disclosure.

The control configuration of the laundry treating apparatus 1 according to one embodiment of the present disclosure will now be described in more detail with reference to FIG. 5.

Like the general laundry treating apparatus, the laundry treating apparatus according to one embodiment of the present disclosure may include a control unit 100 for controlling an overall operation of the laundry treating apparatus 1, a water supply 18 for supplying the washing water, and a drive unit 14 for driving the drum and pulsator. The apparatus 1 may include a brake unit 110 for stopping the operation of the drive unit.

In addition, the apparatus 1 may include the first sensor unit 54 for detecting whether the auxiliary-drum 50 is mounted on the main-drum 30. Further, the apparatus 1 may include the second sensor unit 25 for sensing the rotational position of the main-drum 30. The second sensor unit may be a sensor separate from a sensor in the drive unit 14 or may be a Hall sensor included in the drive unit 14. That is, the second sensor unit 25 may be a sensor for controlling driving of the drive unit 14, particularly, the motors 15 and 16.

First, the first sensor unit 54 senses whether the auxiliary-drum 50 and the main-drum 30 are positioned at a target separation angle corresponding to a desired position. The second sensor unit 25 may be configured to rotate the auxiliary-drum 50 and the main-drum 30 by the spaced apart angles. Therefore, the detection information using the first sensor unit 54 and the rotation angle of the main-drum 30 that are grasped via the control of the motor are associated to each other. Based on this association, precise position control of the auxiliary-drum 50 may be realized.

The laundry treating apparatus according to one embodiment of the present disclosure may have the control panel 200 for user interfacing. The control panel 200 may be provided with various types of input interfaces and display units.

The user may also apply power to the laundry treating apparatus by activating a power input interface 201. That is, in order to use the laundry treating apparatus, first, the user will turn on the laundry treating apparatus by activating the power input interface 201.

When the power of the apparatus is turned on, the user chooses which course the laundry treating apparatus will perform. In one example, the user selects a course to be performed by the laundry treating apparatus. That is, the user may use a course selection unit 203 to select a desired course. In the case of a washing machine, various courses may be selected depending on the material of the laundry, the degree of pollution thereof, the type of laundry, and so on. In one embodiment, not only these washing courses but also various functional courses may be chosen by the user.

The course selection unit may be configured in the form of a button. The course selection unit may be configured as a rotary knob. Whenever the user presses a single button, a desired course may be changed sequentially and selected. Each button corresponding to each course may be configured in the course selection unit.

Once the course is selected, various options for the course may be selected using an option selection unit 204. Various options such as a temperature of the washing water, a degree of spinning, a degree of washing, a degree of contamination, and the number of rinses may be selected. Therefore, the corresponding course to which the user applied the selected options may be performed.

When all selections are finished, the user may actuate a start/pause selection unit 202. In response, the laundry treating apparatus 1 will perform a laundry treatment based on the selected course and option. While the laundry treatment apparatus is operating, the user may also select the start/pause selection unit 202. In response, the laundry treating apparatus may be paused. If the start/pause selection unit 202 is selected again, the laundry treating apparatus is reactivated.

The courses, options, and course progress that the user has selected may be displayed on the display unit 205 in various forms. The display unit may be configured based on a course and an option, and a separate display unit may be provided to indicate course progress.

Thus, the user performs a selection via various selection units. The selection may be confirmed on the display unit. In addition, the user can also visually and/or audibly identify various information on the display unit, such as the current operating status of the laundry treating apparatus, the expected ending time, and so on.

The above-descriptions concerning the control panel 200 may be commonly applied to the general laundry treating apparatus. Further, in the general washing performed using only the main-drum, user selection and course execution may be performed as described above. That is, when the user selects the start/pause selection unit 202 and thereby the laundry treatment is started, the automatically selected laundry treatment is performed or terminated.

In the laundry treating apparatus according to one embodiment of the present disclosure, simultaneous washing and auxiliary washing as well as general washing may be performed. That is, the laundry treating apparatus 1 may perform a general washing mode, a simultaneous washing mode, and an auxiliary washing mode. Any one of these modes may be selectively performed depending on the intention of the user.

That is, while the general laundry treating apparatus performs only a single mode, that is, the general washing mode, the laundry treating apparatus according to the present disclosure may further carry out the simultaneous washing mode and auxiliary washing mode. Therefore, it is highly undesirable to require excessive action to the user or cause confusion to the user in order for the user to select one of the modes. In other words, it is desirable that the user be able to select a desired mode out of the three modes and perform a corresponding laundry treatment, with minimal behavior and without confusion.

First, the user's action of separating the auxiliary-drum from the main-drum may be necessary to perform the general washing mode. Further, the user's action of mounting the auxiliary-drum on the main-drum may be necessary to perform the auxiliary washing mode and the simultaneous washing mode. Except for this essential behavior, it would be desirable for the user to minimize the actions performed for the possible mode selection.

To perform the general washing mode, the user may separate the auxiliary-drum from the main-drum, and, then, the user may select the power input interface 201, the course input interface 203, optionally, the option input interface 204, and the start/pause input interface, as described above. Thus, the general washing mode may be performed automatically and then terminated.

To perform the simultaneous washing mode, the user may mount the auxiliary-drum on the main-drum and select the input interfaces as described above. The simultaneous washing mode may then be automatically performed and terminated.

The actions performed by the user to perform the simultaneous washing mode may be the same as the user actions for the general washing mode, in addition to mounting the auxiliary-drum. Whether or not the auxiliary-drum is mounted may be detected by the first sensor unit 54 as described above. When the control unit determines that the auxiliary-drum is mounted based on the detection from the first sensor unit 54, the control unit may automatically perform and terminate the simultaneous washing mode according to the course and option selected by the user.

In general, the washing course includes washing, rinsing and spinning cycles. When the user selects a specific course A in the general washing mode, the washing cycle, the rinsing cycle and the spinning cycle may be sequentially performed according to the pre-described algorithm. That is, the main-drum may perform the general washing mode.

When the user selects the same course A in the simultaneous washing mode, the main-drum may sequentially perform the washing cycle, rinsing cycle, and spinning cycle according to a pre-described algorithm. In this connection, the simultaneous washing mode is the mode in which washing is performed by the auxiliary-drum. Therefore, the washing cycle, rinsing cycle and spinning cycle in this mode may differ from those in the general washing mode and the simultaneous washing mode, even for the same course A.

In one example, the washing cycle in the simultaneous washing mode may be divided into a washing cycle mainly using the main-drum and a washing cycle mainly using the auxiliary-drum. The former and latter may be performed alternately or sequentially.

Therefore, the washing cycle in the simultaneous washing mode may include the washing cycle using the auxiliary-drum in addition to the washing cycle in the general washing mode. The same principle may be equally applied to the rinsing cycle and the spinning cycle.

Most of the main washing cycle in the general washing mode are performed by driving the pulsator. In the laundry treating apparatus according to one embodiment of the present disclosure, the driving of the pulsator does not rotate the auxiliary-drum or may not form a water-flow inside the auxiliary-drum. Therefore, the washing with the auxiliary-drum is hardly performed by driving the pulsator.

Therefore, in the simultaneous washing mode, a main washing cycle by driving the pulsator and an auxiliary washing cycle for rotating the main-drum and thereby generating a water-flow in the auxiliary-drum may be alternately or sequentially performed.

In the auxiliary washing mode, the auxiliary-drum is mounted on the main-drum, but the laundry is not put into the main-drum, but the laundry is only put into the auxiliary-drum and washed therein. In this case, the main washing cycle by the driving of the pulsator is not performed. That is, only the auxiliary washing cycle in which water-flow is generated in the auxiliary-drum using the rotation of the main-drum may be performed.

To perform the auxiliary washing mode, the user must mount the auxiliary-drum on the main-drum. When the user makes the same selection as in the general washing mode as described above, the simultaneous washing mode may be performed. That is, even though the laundry was not put in the main-drum, water-supply to the main-drum may be performed and the main washing cycle may be performed.

This auxiliary washing mode is a mode in which only the auxiliary-drum is used and a relatively small amount of washing is performed. In the past, in view of the experience of the user using the laundry treating apparatus, the auxiliary washing mode may be a very unusual and special situation to wash using only the auxiliary-drum without using the main-drum.

Accordingly, when the user intends to use the auxiliary washing mode, such a particular recognition from the user must be reflected in the laundry treating apparatus. That is, it is preferable that in the auxiliary washing mode, the selection is performed separately from the selection in the general washing mode and the simultaneous washing mode.

Therefore, it is preferable that an auxiliary washing selection unit 206, which may be separately selected by the user, is configured in the control panel 200 in order to perform the auxiliary washing mode. In addition, an auxiliary washing display unit 207 is preferably provided in the control panel 200 to indicate that the auxiliary washing selection unit 206 is selected. The auxiliary washing selection unit 206 is preferably provided separately from the course selection unit 203.

After the user mounts the auxiliary-drum on the main-drum and selects the power input interface 201, or after the user selects the power input interface 201, and the auxiliary-drum may be mounted on the main-drum by the user, the control unit 100 may determine using the first sensor unit 54 whether the auxiliary-drum 50 is mounted.

First, when the auxiliary-drum 50 is mounted, the user may select the course selection unit 203 or the option selection unit 204. Further, when the user selects the start/pause selection unit 202, the laundry treating apparatus may perform the simultaneous washing mode.

Next, when the auxiliary-drum 50 is not mounted, the same selection from the user may cause the laundry treating apparatus to perform the general washing mode.

Thus, whether or not the auxiliary-drum 50 is mounted is automatically detected by the laundry treating apparatus. In addition, the user does not need to make a different selection from the above selection, in order to perform the general washing mode and the simultaneous washing mode. Therefore, the user may use the general washing mode and the simultaneous washing mode very easily. Further, user confusion may be minimized.

In one embodiment, when the auxiliary-drum 50 is fitted on the main-drum, the user may also use the auxiliary washing mode. That is, the user may use the auxiliary washing mode by selecting the auxiliary washing selection unit 206.

In this connection, the operation in which the user selects the auxiliary washing selection unit 206 means the input of the user's intention to use the auxiliary washing mode. Thus, in this case, the course selection unit 203 associated with washing using the main-drum is preferably deactivated. In addition, it is desirable that the option selection unit 204 associated with the course selection is also deactivated.

The deactivation of the selection unit may mean a state in which the unit may not be selectable by the user. The deactivation of the selection unit may be a state in which the control unit 100 does not reflect the selection even when the user selects the option. When selection of the deactivated selection unit is performed by the user, a beep may sound, or the display unit such as LEDs may be kept off. Thus, when the user selects the auxiliary washing selection unit 206, the user may intuitively recognize that it is not possible to make selections associated with the main washing using the main-drum. In this way, it is possible to prevent the user from being confused.

A typical laundry treating apparatus includes a door-switch. For example, a door-switch for determining whether or not the door for opening and closing the laundry receiving opening is closed is generally provided. With the door closed, the laundry treating apparatus may run. When the door is opened, the laundry treating apparatus may suddenly stop running.

In the general laundry treating apparatus, when the user puts laundry in and closes the door, the user selects a course or the like and then selects the start/pause input interface 202. Assuming that the door-switch detects that the door is closed, when the user inputs the start/pause, the laundry treating apparatus starts an operation for washing.

The laundry treating apparatus according to one embodiment of the present disclosure may include a door-switch 300 as one example of such a door-switch.

When the door-switch 300 senses the closing of the door and then the start/pause input is performed by the user, the operation for washing is started. In this connection, the door may be locked.

The laundry treating apparatus according to one embodiment of the present disclosure may implement three modes as described above. These three modes are related to the detachment/attachment of the auxiliary-drum. Therefore, it may be said that the time when the auxiliary-drum is detached or not is very important.

According to one embodiment of the present disclosure, when the user performs a start/pause input, it is desirable that the apparatus determine attachment or detachment of the auxiliary-drum. More specifically, after the control unit 100 determines that the door is closed using the door switch 300, the control unit 100 preferably determines the attachment or detachment of the auxiliary-drum 50.

When the user selects a course on the course selection unit 202 and inputs start/pause, the laundry treating apparatus determines attachment or detachment of the auxiliary-drum before washing. In this connection, the control unit **100*d* uses the first sensor unit 54** for this determination.

When the user selects a course A and the auxiliary-drum is not installed, the control unit 100 performs the general washing mode. Furthermore, when the auxiliary-drum is mounted, the control unit 100 performs the simultaneous washing mode.

When the user selects the auxiliary washing via the auxiliary washing selection unit 206 and inputs the start/pause, the laundry treating apparatus determines attachment or detachment of the auxiliary-drum before performing the auxiliary washing.

When the auxiliary-drum is not installed, the control unit 100 generates an error indication. The error indication may be displayed using the display unit 205 or an alarm sound. When the auxiliary-drum is mounted, the control unit 100 performs the auxiliary washing mode.

Therefore, according to one embodiment of the present disclosure, a pattern of use of the present apparatus is the same or substantially similar to the pattern of use of the conventional laundry treating apparatus. Therefore, it is very easy for the user to use the present apparatus. That is, in the present apparatus, the user interface is not complicated. Thus, the user's misconception in terms of the operation may be prevented in advance.

Furthermore, since addition or modification of the configuration of the control panel 100, such as the auxiliary washing selection unit may be minimized, the manufacturing cost of the present apparatus is reduced and its production is facilitated.

The laundry treating apparatus according to one embodiment of the present disclosure determines whether the auxiliary-drum 50 is mounted and performs the water-supply based on this determination. The water-supply patterns differ among the three modes as described above. Therefore, it is very important for this apparatus 1 to accurately determine whether the main-drum is equipped with the auxiliary-drum 50. In particular, it is very important that this apparatus accurately control the position of the auxiliary-drum 50. This is because, depending on the position of the auxiliary-drum 50, storage locations of the water supplied through the same water supply 18 may vary.

According to one embodiment of the present disclosure, after the control unit determines whether the auxiliary-drum is loaded, an operation is performed to control the position of the auxiliary-drum for water-supply. In this case, the water-supply is performed after the position of the auxiliary-drum has been located at the target position. This process may be accomplished by the first sensor unit 54, the second sensor unit 25, the control unit 100, the water supply 18, the drive unit 14 and the brake unit 110 as described above.

In this connection, the control unit 100 controls the water supply 18, the motor 14 and the brake unit 110 via a predetermined determination process based on the following signals: sense signals from the first sense unit 54 and second sense unit 25; or a sense signal from the first sensor unit 54, and an output current that is detected while the current of a certain frequency flows through the motor. The sense signal from the second sensor unit 25, or the output current that is detected while the current of a certain frequency flows through the motor may be employed by the control unit 100 to measure the rotation angle of the drum 30.

Hereinafter, referring to FIG. 6, embodiments of determining whether or not the auxiliary-drum is mounted, a position control of the auxiliary-drum, and the water supply will be described in detail. For convenience of explanation, the second sensor unit 25 will be employed by way of example to describe a configuration for sensing the rotation angle of the main-drum. Thus, the second sensor unit 25 may be implemented in a sensorless fashion without the actual sensor, as described above.

Figure 6:
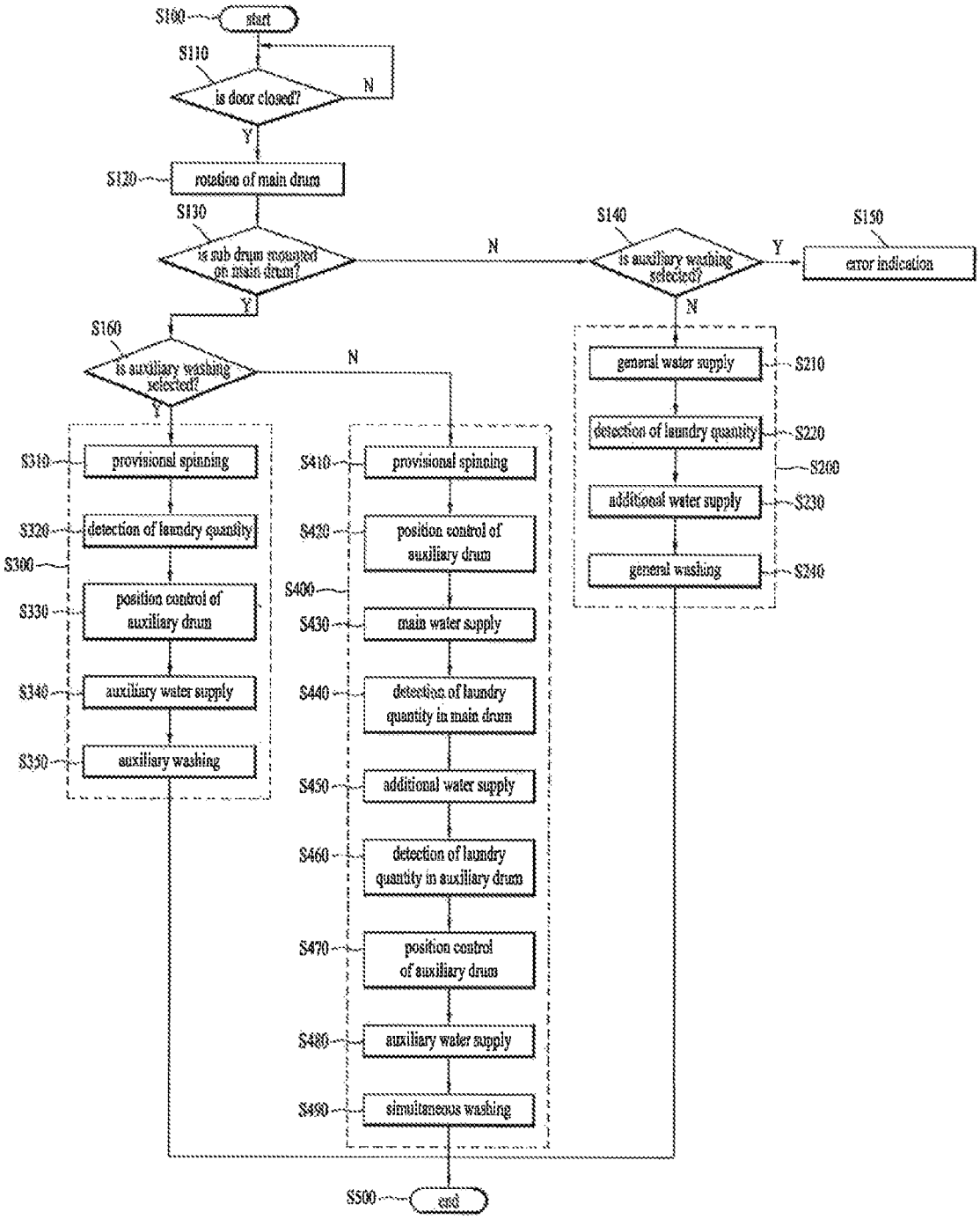
FIG. 6 is a control flow diagram of the laundry treating apparatus according to one embodiment of the present disclosure.

Referring to FIG. 6, operation S130 for determining whether the auxiliary-drum 50 is mounted on the main-drum 30 may be performed to determine whether the washing water should be supplied only to the main-drum 30, or the washing water should be sequentially supplied to the main-drum 30 and the auxiliary-drum 50. In addition, the S130 operation may be performed to determine whether the washing water is supplied only to the main-drum 30 or only to the auxiliary-drum 50.

Specifically, the operation S130 may be performed to perform any one of the general washing mode operation S200, the auxiliary washing mode operation S300, and the simultaneous washing mode operation S400.

Specifically, the control unit 100 first controls the drive unit 14 to rotate the main-drum 30 (S120). That is, the control unit 100 may rotate the main-drum 30 and then determine whether the auxiliary-drum 50 is mounted. When the main-drum 30 rotates, the second sensor unit 25 senses the rotation angle of the main-drum 30 and sends the detection signal to the control unit 100.

In one embodiment, while the second sensor unit 25 detects that the rotation angle of the drum 30 is 360 degrees, no signal is received from the first sensor unit 54. In this case, the control unit 100 determines that the auxiliary-drum 50 is not mounted on the main-drum 30 (S130-N). In one embodiment, the number of this drum rotation may be more than one rotation. However, increasing the number of rotations of the drum to determine whether the auxiliary-drum 50 is installed may lead to excessive time usage. This is because the configuration of the first sensor unit 54 may allow whether or not the auxiliary-drum is mounted be detected even at only one rotation of the main-drum 30.

In this connection, it is desirable that the rotational speed of the drum is low and about 20 RPM.

When it is determined that the auxiliary-drum 50 is not mounted on the main-drum 30, the control unit 100 controls the drive unit to perform the general washing mode S200. That is, the control unit 100 controls the operation of the laundry treating apparatus 1 so that main washing using only the main-drum 30 is performed.

Specifically, the control unit 100 performs a water-supply operation in which the washing water is discharged from the water supply 18 to the main-drum 30 (S210). That is, the control unit performs a general water-supply. The control unit does not control the drive unit 18 and the brake unit 110 such that the outer water-supply guide 570 or the inner water-supply guide 560 is positioned below the single water supply as described below. This is because, in this case, the auxiliary-drum 50 is not mounted on the main-drum 30.

In this connection, the control unit 100 may determine (S140) whether the auxiliary washing is selected by the user before performing the general washing mode S200. That is, this is because the user may select the auxiliary washing input interface 206 without the user mounting the auxiliary-drum 50. In this case, the control unit 100 performs an error indication S150 on the display unit 205. In one embodiment, the operation S130 for determining whether the auxiliary-drum is mounted may determine whether the auxiliary-drum is properly installed.

Furthermore, when the auxiliary washing selection has not been performed, the general washing mode may be performed eventually.

In one embodiment, while the rotation angle of the main-drum 30 is detected to be 360 degrees by the second sensor unit 25, a signal from the first sensor unit 54 may be received by the control unit 100. In this case, the control unit 100 determines that the auxiliary-drum 50 is mounted on the main-drum 30 (S130-Y).

When the auxiliary-drum 50 is determined to be mounted on the main-drum 30, the control unit 100 performs the auxiliary washing mode S300 or the simultaneous washing mode S400. The operation in which the user installs the auxiliary-drum 50 on the main-drum 30 may be interpreted as an expression of the user's intention to use either the auxiliary washing mode or the simultaneous washing mode. Accordingly, the control unit 100 performs a mode input by the user among the auxiliary washing mode or the simultaneous washing mode.

In this connection, the control unit 100 may determine S160 whether the auxiliary washing mode is selected. In one example, the control unit may determine whether the user has selected the auxiliary washing via the auxiliary washing input interface 206. When the user selects the auxiliary washing mode, the control unit 100 performs the auxiliary washing mode S300. Otherwise, the control unit 100 performs the simultaneous washing mode S400.

In the general washing mode as described above, in the general water-supply operation S210, the washing water supplied from the water supply 18 is directly supplied to the main-drum 30. This is because the auxiliary-drum 50 is not interposed between the main-drum 30 and the water supply 18.

However, in the auxiliary washing mode and the simultaneous washing mode, the auxiliary-drum 50 is interposed between the main-drum 30 and the water supply 18. Thus, with bypassing the auxiliary-drum 50, the water-supplying to the main-drum 30 may be performed. Alternatively, a direct water supply to the auxiliary-drum 50 may be performed. To this end, auxiliary-drum position control operations S330, S420, and S470 may be performed. In other words, when the auxiliary-drum 50 is mounted, the control unit 100 controls the drive unit 18 and the brake unit 110 to position the auxiliary-drum 50 at a predetermined position. The predetermined position of the auxiliary-drum 50 may be referred to as a position in which only the auxiliary-drum 50 receives water through the water supply 18 and a position in which the main-drum 50 receives water through the water supply 18.

In the auxiliary washing mode, water is only supplied to the auxiliary-drum 50, while in the simultaneous washing mode, both the auxiliary-drum 50 and the main-drum 30 must be water-supplied.

Specifically, the control unit 100 control the drive unit to position the outer water-supply guide 570 under the water supply 18 and then performs the main water-supply S430 for supplying water to the main-drum 30. Furthermore, after the main water-supply, the control unit 100 rotates the auxiliary-drum 50 by a predetermined angle to position the inner water-supply guide 560 under the water supply 18. Then, the auxiliary water-supply S480 for supplying water to the auxiliary-drum 50 is performed. These main water supply and auxiliary water supply are performed sequentially in the simultaneous washing mode. It is preferable to perform the auxiliary water-supply after the main water-supply such that the laundry quantity of the main-drum and the laundry quantity of the auxiliary-drum are detected as described below. Further, in the auxiliary washing mode, the main water supply may be omitted and only the auxiliary water-supply S340 may be performed. In this connection, the configuration has been described in which the auxiliary water-supply is performed after the main water-supply. However, the present disclosure is not limited thereto. This is for convenience of explanation. After the auxiliary water-supply, the main water-supply may be carried out.

In the auxiliary washing mode and the simultaneous washing mode, the position control of the auxiliary-drum may be performed via following embodiments.

The control unit 100 may control the drive unit 14 so that the auxiliary-drum 50 rotates at a very low RPM for water-supply. In this connection, the RPM may be set to, for example, lower than 10 RPM, and more specifically, may be set to 3 RPM. When the first sensor unit 54 sends a sense signal to the control unit 100, the control unit 100 rotates the auxiliary-drum 50 by a predetermined rotation angle from the time point when the first sensor unit 54 sends the sense signal to the control unit 100. In this way, the outer water-supply guide 570 may be positioned under the water supply 18. This rotation angle may be set in advance based on the arrangement relationship of the first sensor unit 54, the outer water-supply guide 570, and the water supply 18.

The rotation angle of the auxiliary-drum 50 is measured by the second sensor unit 25 while the auxiliary-drum 50 rotates at a very low RPM. Then, the measured angle is transmitted to the control unit 100. When the control unit 100 determines that the measured rotation angle has reached a preset rotation angle. The control unit may control the brake unit 110 so that the auxiliary-drum 50 is stopped.

Since the RPM of auxiliary-drum 50 is very low, the distance or angle by which the auxiliary-drum 50 slides from the time when the brake unit 110 is operated is negligibly small. When the auxiliary-drum 50 is braked by the brake unit 110, most of the outer water-supply guide 570 is located under the single water supply 18. Thus, the washing water discharged from the water supply 18 may be supplied to the main-drum 30 through the outer water-supply guide 570, without modifying the position of the auxiliary-drum 50.

The principle of rotating and braking the auxiliary-drum 50 for water-supply through the inner water-supply guide 560 is the same as the principle of rotating and braking the auxiliary-drum 50 for water-supply through the above-described outer water-supply guide 570. Therefore, a description thereof will be omitted In the auxiliary washing mode and the simultaneous washing mode, the position control of the auxiliary-drum may be performed via another embodiment as follows.

The control unit 100 may control the drive unit 14 to raise the RPM of the auxiliary-drum 50 such that the auxiliary-drum 50 slides from a point where braking is started. In this connection, the RPM may be set to, for example, 15 to 25 RPM, but is not limited thereto. In this example, the rotation angle of the auxiliary-drum rotating such that the outer water-supply guide 570 is positioned below the water supply 18 when the first sensor unit 54 sends the sense signal to the control unit 100 may be pre-defined based on the arrangement relationship between the first sensor unit 54, the outer water-supply guide 570 and the water supply 18.

However, the predetermined rotation angle of this example may be set to have the same value as the predetermined rotation angle of the previous one example. Considering the distance by which the auxiliary-drum slides, the preset rotation angle of this example may be set to be smaller than the preset rotation angle of the previous one example.

As in the previous one example, the rotation angle of the auxiliary-drum 50 is measured and transmitted to the control unit 100 by the second sensor unit 25 while the auxiliary-drum 50 is rotating. When the control unit 100 determines that the measured rotation angle has reached a preset rotation angle, the brake unit 110 is controlled so that the auxiliary-drum 50 stops.

The auxiliary-drum 50 has various sliding angles by which the drum 50 slide from the point where the braking is initiated due to the weight of the washing water and the laundry, as well as its own weight. That is, when the inertia is large, the sliding angle or slip angle increases. When the second sensor unit 25 measures the sliding angle of the auxiliary-drum 50 and transmits the measured angle to the control unit 100, the control unit 100 modifies the previous preset rotation angle.

For example, when the sliding angle of the auxiliary-drum 50 is such that the outer water-supply guide 570 passes under and beyond the water supply 18, the control unit 100 may be configured to modify the prescribed rotation angle value to be smaller. In the opposite case, the control unit 100 may be configured to modify the prescribed rotation angle value to be larger. As described above, the auxiliary-drum 50 rotates merely at a very low rotational speed, such as 3 RPM. Alternatively, when the auxiliary-drum 50 rotates at a high rotational speed, the speed may be merely, for example, in a range of from 15 to 25 RPM. Thus, the water-supply may impose very little load on the drive unit 14.

In one embodiment, when the control unit performs the position control of the auxiliary-drum at a very low rotational speed of the order of 3 RPM, the time required for the position control of the auxiliary-drum may take a relatively long time. That is, although the slip angle due to inertia is negligible and thus the position control of the auxiliary-drum is very simple, this is disadvantageous in that it takes much time.

On the other hand, when the slip angle is measured and, hence, the position control of the auxiliary-drum is carried out using the measured slip angle, this approach is based on the slip angle due to inertia. In other words, this approach may allow driving the drum at a rotational speed, which causes the inertial force enough to cause the slip. Thus, although the position control of the auxiliary-drum is complicated in this approach, the time required for the position control of the auxiliary-drum is smaller in this approach.

In this connection, the position control of the auxiliary-drum may be a pre-operation for the water-supply. Therefore, as the time required for the position control of the auxiliary-drum becomes longer, the whole laundry treatment time will increase. Thus, adding an algorithm, rather than adding a new component would be more desirable in performing the position control of the auxiliary-drum using the slip angle.

Hereinafter, a method for controlling the laundry treating apparatus according to one embodiment of the present disclosure will be described in detail.

It is highly desirable to measure the laundry quantity accurately in performing washing and then to carry out the washing based on the measured quantity. This is because an amount of the washing water, a washing strength, and a washing time, etc. may be appropriately controlled depending on the laundry quantity, thereby to achieve an optimum washing effect. In recent years, the laundry treating apparatus, which automatically injects detergents, has also been provided. Thus, it is desirable that the amount of auto-dispensed detergent is determined based on the measured laundry quantity.

In the case of the general washing mode using the main-drum for washing, various methods of detecting the laundry quantity are being used. In one example, the laundry quantity may be measured based on a current value in the motor depending on a load when rotating the main-drum. That is, as the laundry quantity increases, the load of the motor increases. Therefore, the current value flowing to the motor is increased. Therefore, it is possible to estimate the laundry quantity in the main-drum relatively accurately based on the current value.

However, in the laundry treating apparatus according to the present embodiment, the auxiliary-drum may be mounted on the main-drum. Therefore, the load of the motor in the auxiliary-drum-mounted mode may be different from the load of the motor in the general washing mode. That is, a load due to the auxiliary-drum itself and a load due to the laundry quantity inside the auxiliary-drum may be further added. Particularly, a magnitude of the load may be further varied depending on a state of the laundry as accommodated in the auxiliary-drum.

In one example, even in the same amount of laundry, the load of the motor may vary depending on whether it is dry laundry or wet laundry. Further, the load of the motor may be variable when the main-drum contains water. Therefore, in the case of the simultaneous washing, it is not easy to estimate the accurate laundry quantity in the main-drum.

Further, in the case of the simultaneous washing or auxiliary washing mode, it is not easy to estimate the exact laundry quantity inside the auxiliary-drum. This is because the driving of the auxiliary-drum is not performed individually and independently of the driving of the main-drum. That is, there is no separate component such as a separate motor for rotating only the auxiliary-drum.

Thus, in the single laundry treating apparatus, a method needs to be provided by which the laundry quantities in the main-drum and the auxiliary-drum can be accurately estimated in the case of the simultaneous washing mode, and, by which, in the case of the auxiliary washing mode, the laundry quantity in the auxiliary-drum can be accurately measured First, in the general washing mode, it is possible to detect the main laundry quantity by using the current value flowing in the motor when driving the main-drum. As will be described later, it is also possible to use a method of detecting the main laundry quantity in the simultaneous washing mode.

In the auxiliary washing mode, there is no laundry in the main-drum, while the auxiliary-drum is mounted on the empty main-drum. Therefore, there is no need to detect the laundry quantity in the main-drum. Since the auxiliary-drum is mounted on the main-drum, the auxiliary-drum may also rotate with the main-drum. Thus, the auxiliary-drum may act as a load added to the motor that rotates the main-drum. Further, when the washing water is supplied to the auxiliary-drum, the washing water as supplied increases the load of the main-drum. Therefore, it is desirable to detect the auxiliary laundry quantity in the auxiliary-drum before the washing water is supplied.

Specifically, when the main-drum 30 is rotated, a load is applied to the motor of the drive unit. In this response, the current value flowing in the motor will change. That is, when the load is large, the current value is large. When the load is small, the current value becomes small. Moreover, the current value generated from the motor when the main-drum 30 is rotated after mounting the empty auxiliary-drum onto the empty main-drum may be experimentally determined. That is, this value may be called a basic current value. In this connection, the basic current value may be the smallest current value that may flow in the motor when rotating the main-drum and auxiliary-drum.

As the laundry quantity in the auxiliary-drum increases, the measured current value gradually increases. Therefore, a current value calculated by subtracting the basic current value from the measured current value may be a current value corresponding to the auxiliary laundry quantity. The control unit may estimate the auxiliary laundry quantity using the calculated current value. In this connection, a current and laundry quantity table may be created by matching the measured current values with the corresponding auxiliary laundry quantities. The control unit 100 may detect the auxiliary laundry quantity using the table.

As another example, when the main-drum 30 is rotated and then stopped, the slip angle of the main-drum 30 is generated by the inertia force. As the auxiliary laundry quantity increases, the slip angle is increased relative to a slip angle generated in the case of the empty main-drum 30 and the empty auxiliary-drum 50. Thus, the apparatus generates a table between the slip angles and the corresponding auxiliary laundry quantities. The apparatus may also detect the auxiliary laundry quantity using the table.

In one embodiment, the auxiliary laundry quantity may be relatively easily estimated since the laundry has not been put into the main-drum in the auxiliary washing mode. However, in the case of the simultaneous washing mode, it is not easy to detect the main laundry quantity and the auxiliary laundry quantity. As in measuring the auxiliary laundry quantity, the control unit may measure a current value flowing in the motor by rotating the main-drum. However, most of the magnitude of the current value as measured may be affected by either the main laundry quantity or the auxiliary laundry quantity. Alternatively, both of them may affect the current value to the same extent.

Therefore, it is necessary to propose a method for effectively detecting the main laundry quantity and the auxiliary laundry quantity individually in the case of simultaneous washing.

According to this embodiment, the pulsator 35 is provided only on the main-drum 30. Thus, the driving of the pulsator only affects the main laundry quantity. Taking this into consideration, an approach of detecting the main laundry quantity based on the driving of the pulsator 35 is presented.

The drive of the main-drum as described above means the drive in which the main-drum and the pulsator are integrally rotated via driving the motor. The driving of the pulsator means that the main-drum remains non-rotated and the pulsator rotates only. The auxiliary-drum rotates via rotation of the main-drum. That is, the pulsator drive and the auxiliary-drum rotation are not related to each other.

When the main-drum has the larger main laundry quantity, the resistance of the driving of the pulsator becomes larger. That is, the current value flowing in the motor driving the pulsator becomes larger. Accordingly, the control unit may detect the main laundry quantity based on the current value flowing in the motor when the pulsator is driven. Likewise, correlating the measured current values with the corresponding main laundry quantity values may result in creating a table between them. Thus, the control unit may determine the main laundry quantity based on the table.

In one embodiment, the user puts dry laundry into the main-drum. Such dry laundry may be inserted into the main-drum in a wrinkled state, and thus may not be in close contact with the pulsator 35. That is, even when the pulsator 35 rotates, a space is formed between the dry laundry and the pulsator. Thereby, the resistance applied to the pulsator 35 due to the laundry may be reduced and the pulsator 35 may be smoothly rotated. In this case, even when the laundry quantity is large, the current value measured in the motor may be relatively small.

Therefore, it is preferable that, in order to detect the main laundry quantity, the main water supply S430, which supplies the washing water to the inside of the main-drum, is performed first. When the washing water is supplied, the dry laundry absorbs moisture and become heavy and then falls by gravity. Thus, wet laundry is brought into close contact with the pulsator. Then, the pulsator may receive sufficient resistance from the wet laundry. In this case, as the laundry quantity becomes larger, the resistance applied to the pulsator may be proportionally increased in accordance with the laundry quantity.

In this connection, the washing water quantity input at the main water supply S430 may be set in advance. That is, a pre-described amount of the washing water may be supplied. This preset quantity may be called a basic washing water quantity. The basic washing water quantity may indicate a washing water quantity used for the minimum laundry quantity. In this connection, an adjustment of the washing water quantity may be performed by adjusting the water-supply time. In one embodiment, the apparatus may also use a water-level sensor provided in the tub to adjust the washing water quantity. The water-level sensor provided in the tub has a general configuration, and, hence, a detailed description thereof will be omitted.

The control unit may measure the current value at the motor based on the increase and decrease of the washing water quantity and the laundry quantity. The current values measured based on the increases and decreases of the basic washing water quantity and the laundry quantity may be tabulated. That is, when the current values are measured, the main laundry quantities corresponding to the measured current values may be determined. In this connection, as the measured current value becomes larger, the main laundry quantity may be larger.

In this connection, the current value sensed when detecting the main laundry quantity may be a value measured in the motor when the motor drives the pulsator. Since the control unit has detected the main laundry quantity, the control unit is able to drive the main-drum in consideration of the main laundry quantity and, thereby to determine the auxiliary laundry quantity.

As the auxiliary laundry quantity is increased relative to the detected main laundry quantity, the current value flowing in the motor when the main-drum is driven increases. In this connection, the measured current value may be the sum of the load due to the main laundry quantity and the load due to the auxiliary laundry quantity. In addition, in the case of the same main laundry quantity, and in the absence of the auxiliary laundry quantity, a current value may be obtained in advance. A difference between the previous current value in the presence of the auxiliary laundry quantity and the latter current value in the absence of the auxiliary laundry quantity may be calculated. The control unit may estimate the auxiliary laundry quantity based on the calculated value. In this connection, as the current value difference increases, this means that the auxiliary laundry quantity is larger.

Thus, the auxiliary laundry quantity may be determined as follows. The control unit may first determine the main laundry quantity and then determine the auxiliary laundry quantity based on the determined main laundry quantity. In this connection, it may be recognized that for the detection or determination of the auxiliary laundry quantity, the control unit preferably drives the main-drum.

In one embodiment, the control unit is able to detect the auxiliary laundry quantity using the slip angle without using the current value. When the main laundry quantity is larger, the slip angle increases. However, since the main laundry quantity was first detected, the slip angle according to the detected main laundry quantity may be obtained in advance.

In addition, when the auxiliary laundry quantity is added in addition to the main laundry quantity, the slip angle may be further larger. That is, as the auxiliary laundry quantity increases, the slip angle occurring until the main-drum stops after it rotates is further increased. Thus, for each main laundry quantity, the slip angle may be tabulated based on the auxiliary laundry quantity. The control unit may estimate the auxiliary laundry quantity based on the relationship between a predetermined main laundry quantity and the slip angle.

Therefore, according to this embodiment, even in simultaneous washing mode, the control unit can accurately estimate the main laundry quantity and the auxiliary laundry quantity and perform optimal washing based on the estimated value. In particular, the present disclosure may provide a more effective approach to detect the main laundry quantity and auxiliary laundry quantity individually such that it is excluded that the auxiliary laundry quantity affects the detection of the main laundry quantity, and, hence, the measurements or detections of the auxiliary laundry quantity and the main laundry quantity are performed individually.

As described above, the auxiliary-drum 50 is only a component that provides a space in which the laundry is accommodated. That is, since the auxiliary-drum is a component that can be attached on or detached from the main-drum 30, the auxiliary-drum 50 is preferably a container without any additional electrical components. Therefore, it is preferable that the auxiliary-drum 50 exclude a component, such as a sensor, which receives a current and generates a signal output.

For this reason, it is preferable that the auxiliary-drum 50 is not provided with the water-level sensor. Therefore, it is not easy to supply the washing water at an appropriate quantity to the auxiliary-drum 50. In this embodiment, the control unit may be configured to supply the washing water at an appropriate quantity via water-supply time adjustment. That is, when the auxiliary laundry quantity is large, the control unit may be configured for increasing the water-supply time such that a larger quantity of the washing water is supplied.

In this regard, following issues arise. That is, due to the nature of this auxiliary-drum 50, it cannot detect a quantity of initially-remaining water or distinguish it from the auxiliary laundry quantity.

That is, the user may put wet laundry into the auxiliary-drum 50 rather than putting dry laundry in the auxiliary-drum 50. Further, when the user performs rough washing of the laundry in the auxiliary-drum 50 and then does not throw away the wash water therein. Thus, the already used water remains in the drum 50 without being discharged from the auxiliary-drum 50. In this case, the user may also mount the auxiliary-drum 50 on the main-drum 30 while the already used water remains in the drum 50. In other words, the water initially remains in the auxiliary-drum 50 from the beginning of the auxiliary washing. Thus, the laundry quantity in the auxiliary-drum 50 may be incorrectly detected due to the water remaining initially.

Therefore, there is no way to know correctly the target quantity of water in the auxiliary-drum regardless of whether the quantity of water in the auxiliary-drum is large or small. Further, the greater the quantity of the initially residual water, this results in that the incorrect amount of the auxiliary laundry quantity is detected from the perspective of the auxiliary laundry quantity as mentioned above, regardless of the actual auxiliary laundry quantity. Thus, the control unit cannot detect the correct target auxiliary laundry quantity.

In one example, a user may perform a rough laundry in the auxiliary-drum. Thereafter, the user may mount the auxiliary-drum filled with water and the laundry onto the main-drum. This is often the case for users who intend to save water. The main-drum as described above can also detect the quantity of water using the water-level sensor mounted thereon. This is for a following purpose: the control unit may sense the quantity of water via the water-level sensor before the main water-supply and, if necessary, reduce the main water-supply amount or omit the main water-supply. Therefore, in detecting the main laundry quantity via the driving of the pulsator, and in the case of the main-drum, the effect of the quantity of initially-remaining water in the main-drum on the detection of the main laundry quantity may be minimized.

However, according to this embodiment, it is not easy to provide an approach that minimizes the impact of the quantity of the initially-remaining water in the auxiliary-drum on the measurement or detection of the auxiliary laundry quantity.

For this reason, when the auxiliary-drum is filled with the initially-remaining water, the auxiliary laundry quantity within the auxiliary-drum may be detected to the maximum level. In this case, the washing water may be supplied to the auxiliary-drum in the maximum quantity corresponding to the maximum auxiliary laundry quantity. In this connection, the washing water as supplied may overflow out of the auxiliary-drum. This situation is not very desirable. This is because the washing water may be wasted, and the user may mistake this situation as the failure of the laundry treating apparatus. In addition, there occurs a problem that due to the initially remaining water, the washing water with the correct target quantity may not be supplied.

Thus, as shown in FIG. 6, according to one embodiment of the present disclosure, it is preferable to perform a provisional spinning operation S310 and S410 when starting the auxiliary washing mode S300 and simultaneous washing mode S400. That is, it is desirable to first discharge the water initially contained in the auxiliary-drum before water-supplying to the auxiliary-drum.

The provisional spinning may be done via the rotation of the main-drum to discharge the water inside the auxiliary-drum to the outside of the auxiliary-drum using the centrifugal force. When water is initially present in the auxiliary-drum, contaminants therein are discharged together with the water via the provisional spinning. This is not intended for a waste of water, but rather a boost in the effectiveness of subsequent washing using the auxiliary-drum. The provisional spinning may allow a large amount of water to be discharged together with the contaminants therein. Thus, the decomposition effect of the contaminants by the detergent may be further promoted during the subsequent washing.

When using the rotation of the main-drum to wash the laundry inside the auxiliary-drum, the main-drum may rotate at approximately 90 to 100 RPM (revolution per minute). At this level of RPM, sufficient water-flow may be generated within the auxiliary-drum. As the rotation RPM of the main-drum increases, the water in the auxiliary-drum moves radially outwards and upwards by the centrifugal force. Thus, when the rotation RPM of the main-drum is at approximately 120 to 130 RPM, the water inside the auxiliary-drum may be discharged to the outside by the centrifugal force.

However, when the provisional period for the provisional spinning is prolonged, the entire washing time may increase. Therefore, it is desirable to raise the rotation RPM of the main-drum so that the water is quickly discharged to the outside of the auxiliary-drum. However, when the rotation RPM of the main-drum becomes too high, a problem that the discharged water is scattered outwards may occur. In the case of an RPM adjacent to approximately 270 RPM, water may be scattered outwards. Therefore, it is desirable to perform the provisional spinning at an RPM (in one example, 270 RPM) before the water is scattered.

Generally, the main spinning RPM of the main-drum is greater than 400 RPM inclusive. Thus, at the time of the main spinning of the main-drum at this RPM speed, water inside the auxiliary-drum may be scattered. Therefore, in spinning operation in the simultaneous washing mode, the main-drum spinning is preferably performed after auxiliary-drum spinning.

Specifically, at the time of spinning start, the water in the tub is discharged by driving the water discharge pump. Therefore, a large amount of water is discharged from the main-drum.

The provisional spinning is then started at an approximately 270 RPM. During the provisional spinning, water in the main-drum is discharged to some extent by the centrifugal force.

After the provisional spinning, the main-drum rotates at greater than 400 RPM inclusive and performs the spinning non-provisionally. At the time of the provisional spinning, a large quantity of the washing water was discharged from the auxiliary-drum. Thus, the quantity of water as scattered during the main spinning is very small. Thus, performing the main-drum spinning after the provisional spinning may allow the water in the laundry, which is provided in the auxiliary-drum and in the main-drum, respectively, to be drained sufficiently.

Hereinafter, the general washing mode, the auxiliary washing mode, and the simultaneous washing mode will be described in detail with reference to FIG. 6.

Since the three modes can be performed in one washing machine, it is necessary to determine whether the auxiliary-drum is installed. Depending on the determination result, any one of the above three modes may be performed.

When the auxiliary-drum is not mounted, the general washing mode S200 may be performed.

The general washing mode S200 may be performed while starting the general water-supply S210. In the general water-supply S210, a small amount of the washing water is supplied. Thereafter, a laundry quantity detection operation S220 may be performed. Based on the detected laundry quantity, an additional water-supply S230 may be performed, if necessary.

When the watering is complete, the general washing mode may be automatically performed S240 and then terminated S500. The general washing may include washing, rinsing, and spinning operations. That is, the washing cycle, the rinsing cycle, and the spinning cycle may be performed in this order according to the pre-described algorithm. In this connection, the driving manner of the main-drum and the pulsator will be the same as or similar to the driving manner in the conventional laundry treating apparatus. Such driving may be referred to as general driving.

That is, when the user selects a course without attaching the auxiliary-drum onto the main-drum, the general washing mode may be automatically performed and terminated.

When the auxiliary-drum is installed onto the main-drum, the auxiliary washing mode S300 may be performed.

The auxiliary washing mode S300 may be performed while starting the auxiliary laundry quantity detection operation S320.

The auxiliary laundry quantity detection operation S320 may be performed by driving the main-drum. In one embodiment, it would be desirable to perform the provisional spinning S310 before the auxiliary laundry quantity detection operation S320, in order to detect the correct auxiliary laundry quantity.

When the auxiliary laundry quantity is detected, the washing water should be supplied to the auxiliary-drum S340 based on the detected supplemental laundry quantity. to perform the auxiliary water-supply S340, an auxiliary-drum position control S330 is preferably performed.

After the auxiliary-drum position control is performed, carrying out the water supply may allow the washing water to be supplied only to the auxiliary-drum.

The auxiliary-drum position control means that the auxiliary-drum is rotated so that a specific portion of the auxiliary-drum is stopped at a specific position. It is preferable that in order to facilitate the separation of the auxiliary-drum from the main-drum by the user using the handle, the handle is located at the specific position (in one example, in a horizontal direction).

When the supply of washing water is completed, the auxiliary washing may be automatically performed S350 and may be terminated S500. Likewise, the auxiliary washing may include washing, rinsing, and spinning. That is, the washing cycle, the rinsing cycle, and the spinning cycle may be performed in this order according to the pre-described algorithm. In this connection, the main-drum and pulsator drive manner will be different from that in the conventional laundry treating apparatus. The pulsator drive will be omitted. Driving of the main-drum may only include driving for generating water-flow inside the auxiliary-drum and driving for spinning. Such driving may be referred to as auxiliary driving.

When the auxiliary-drum is installed onto the main-drum, the auxiliary washing mode S300 may be performed.

The simultaneous washing mode S400 may be performed while starting the main-drum laundry quantity detection operation S440. The main-drum laundry quantity detection operation S440 may also be performed by driving the pulsator. In one embodiment, after the main water supply S430, the main-drum laundry quantity detection S440 may be performed in order to detect the correct main laundry quantity and to exclude the influence of the auxiliary laundry quantity. Furthermore, in order to perform the main water supply S430, an auxiliary-drum position control S420 may be performed. This allows the washing water to be supplied only to the main-drum, not the auxiliary-drum.

In one embodiment, after the main-drum laundry quantity detection operation S440, an additional water-supply S450 may be performed. That is, the control unit may additionally supply the washing water, if necessary, based on the detected main laundry quantity. When the additional water-supply is complete, preparation for washing the laundry inside the main-drum may be considered to be completed.

To wash the laundry inside the auxiliary-drum, an auxiliary-drum laundry quantity detection operation S460 may be performed. In this connection, the auxiliary-drum laundry quantity detection operation S460 may be performed by driving the main-drum.

It is preferable to discharge the initially-remaining water in the auxiliary-drum in order to accurately detect the auxiliary laundry quantity. Therefore, the provisional spinning S410 is preferably performed before performing the auxiliary-drum laundry quantity detection S460. The provisional spinning S410 may be performed before the auxiliary-drum laundry quantity detection S460 and after the additional water-supply S440. The simultaneous washing mode S400 may be performed by starting the provisional spinning S410.

When the auxiliary laundry quantity is detected, an auxiliary water-supply S480 may be performed based on the detected auxiliary laundry quantity. For the auxiliary water-supply operation S480, auxiliary-drum position control S470 is preferably performed first. When the auxiliary water-supply S480 is complete, the preparation for washing the laundry inside the auxiliary-drum may be considered to be completed.

When the supply of the washing water is completed, the simultaneous washing mode may be automatically performed S490 and may be terminated S500. Likewise, the simultaneous washing may include washing, rinsing, and spinning. That is, the washing cycle, the rinsing cycle, and the spinning cycle may be performed in this order according to the pre-described algorithm. In this connection, the main-drum and pulsator driving manner will be a mixture of the general drive and the auxiliary drive. These general and auxiliary driving operations are performed sequentially or alternately. As a result, the main washing and auxiliary washing may be performed simultaneously and may be completed in a simultaneous manner.

As described above, in the simultaneous washing mode S400, there are at least three stages (that is, main, auxiliary, and additional stages) in the water-supply. To do this, at least two auxiliary-drum position controls are performed. In this connection, the auxiliary-drum position control may be an operation independent from the washing. The time required for this control operation increases the overall washing time. Therefore, it is preferable that the auxiliary water-supply S480 is performed after the main water supply S430 and the additional water-supply S450 are all terminated.

In one embodiment, the configuration that after the auxiliary water-supply S480, the main water-supply S430 and the additional water-supply S450 are performed may be desirable in terms of the two auxiliary-drum position controls. However, since the main laundry quantity must be detected first and then the auxiliary laundry quantity must be detected, the configuration that the auxiliary water supply is performed after main water supply and additional water supply is desirable in terms of the laundry quantity detection.

As described above, the general washing mode may be performed in the same manner as in the general washing machine. In one embodiment, further operation may be performed to determine whether the auxiliary-drum is installed in this case. However, when the auxiliary drum is installed, either the auxiliary washing mode or the simultaneous washing mode must be performed. Therefore, it is necessary that the auxiliary washing mode and the simultaneous washing mode are clearly distinguished from each other, thereby to prevent a malfunction or a false sense from occurring.

In one example, the case in which when the auxiliary washing mode needs to be performed, the simultaneous washing mode is performed, or the opposite case needs to be prevented in advance. In the former case, the washing water and time are unnecessarily consumed, while in the latter case, the laundry in the main-drum may not be washed. Thus, it may be necessary for the user to actively select either the auxiliary washing mode or the simultaneous washing mode as well as to mount the auxiliary-drum on the main-drum. This may be burdensome.

When the auxiliary-drum is installed, either the auxiliary washing mode or the simultaneous washing mode may be performed depending on whether auxiliary washing mode is selected. When the auxiliary washing is selected via the auxiliary washing input interface 206 shown in FIG. 5, the auxiliary washing mode is performed. Otherwise, the simultaneous washing mode may be performed. The auxiliary washing input interface may be replaced with a simultaneous washing input interface. In this case, when the user selects the simultaneous washing input interface, the simultaneous washing mode is performed. When the user does not select the simultaneous washing input interface, the auxiliary washing mode may be performed.

In one embodiment, the apparatus may have both the auxiliary washing input interface and the simultaneous washing input interface to prevent misleading or confusing the user. The user may select either the auxiliary washing input interface or the simultaneous washing input interface. That is, the apparatus may be configured such that both the auxiliary washing input interface and the simultaneous washing input interface be exclusively selected.

When the user inputs the auxiliary washing mode, the auxiliary washing mode may be performed based on the determination result from the S160 operation as shown in FIG. 6. When the user inputs the simultaneous washing mode, the simultaneous washing mode may be performed based on the determination result from the S160 operation as shown in FIG. 6.

When the user inputs the auxiliary washing mode, an error indication S150 may be performed based on the determination result from the S140 operation as shown in FIG. 6. When the user inputs the simultaneous washing mode, an error indication S150 may be performed based on the determination result from the S140 operation as shown in FIG. 6. In one embodiment, when the user inputs the simultaneous washing, this may be negated in the S140 operation shown in FIG. 6 and, rather, the general washing mode may be performed.

Although, as described above, the present disclosure is described by the above defined embodiment and drawings, the present disclosure is not limited thereto. Rather, it is to be understood that the invention is not limited to the disclosed embodiments, but, on the contrary, is intended to cover various modifications and equivalent arrangements included within the spirit and scope of the claims.

The invention claimed is:

1. A method for controlling a laundry treating apparatus that comprises a main-drum, an auxiliary-drum configured to be removably mounted on the main-drum and a motor for driving the main-drum and a pulsator disposed in the main-drum, wherein the laundry treating apparatus is configured to perform a general washing mode in which laundry in the main-drum is washed while the auxiliary drum is separated from the main drum, an auxiliary washing mode in which only laundry in the auxiliary-drum is washed while the auxiliary-drum is mounted on the main-drum and a simultaneous washing mode in which laundry in the auxiliary-drum and laundry in the main-drum are washed while the auxiliary-drum is mounted on the main-drum, wherein the method comprises:

performing a main laundry quantity detection operation for detecting a laundry quantity in the main-drum via rotation of the pulsator; and performing an auxiliary laundry quantity detection operation for detecting a laundry quantity in the auxiliary-drum by driving the main-drum, wherein the auxiliary laundry quantity detection operation is performed based on the laundry quantity in the main-drum, wherein the main laundry quantity detection operation is performed before the auxiliary laundry quantity detection operation in the simultaneous washing mode, and wherein in the auxiliary laundry quantity detection operation, the auxiliary laundry quantity corresponds to a value calculated by subtracting a current value corresponding to the detected main laundry quantity from a current value measured in the motor when the main-drum rotates, or the auxiliary laundry quantity corresponds to a value calculated by subtracting a slip angle corresponding to the detected main laundry quantity from a slip angle upon braking the main-drum after rotation of the main-drum.

2. The method of claim 1, wherein, the method further comprises performing an operation for determining whether the auxiliary-drum is mounted on the main-drum.

3. The method of claim 2, wherein the operation for determining whether the auxiliary-drum is mounted on the main-drum includes rotating the main-drum.

4. The method of claim 3, wherein the operation for determining whether the auxiliary-drum is mounted on the main-drum is performed before the main laundry quantity detection operation.

5. The method of claim 2, wherein the laundry treating apparatus comprises:

a control panel provided with a start/pause input interface configured to allow an operator to control the apparatus to start laundry treatment; and a door for opening and closing an opening in the main-drum, wherein after the door is closed and the start/pause input interface is activated, the operation for determining whether the auxiliary-drum is mounted on the main-drum is performed.

6. The method of claim 5, wherein the control panel includes:

an auxiliary washing input interface configured to be actuated by the operator to select the auxiliary washing mode; and a simultaneous washing input interface configured to be actuated by the operator to select the simultaneous washing mode.

7. The method of claim 6, further comprising:

performing a main water-supply operation for supplying washing water into the main-drum; and performing an auxiliary water-supply operation for supplying washing water into the auxiliary drum after the main water-supply operation is finished.

8. The method of claim 7, wherein the main laundry quantity detection operation is performed after the main water-supply operation is started.

9. The method of claim 8, wherein the laundry treating apparatus includes a water supply disposed above the main-drum to discharge washing water, wherein the method further comprises performing an operation for controlling a position of the auxiliary drum before the main water-supply operation and the auxiliary water-supply operation are performed, such that washing water discharged from the water supply is supplied to either the main drum or the auxiliary drum.

10. The method of claim 9, wherein the method further comprises, after the main laundry quantity detection operation, performing an additional water-supply operation for supplying water into the main-drum based on the laundry quantity in the main drum.

11. The method of claim 10, wherein the auxiliary laundry quantity detection operation is performed after the additional water-supply operation.

12. The method of claim 11, wherein the auxiliary water-supply operation is configured to supply washing water based on the laundry quantity in the auxiliary-drum after the auxiliary laundry quantity detection operation.

13. The method of claim 12, wherein a quantity of washing water supplied in the auxiliary water-supply operation is controlled based on a duration of supplying washing water through the water supply.

14. The method of claim 13, wherein the method further comprises performing a provisional spinning operation for discharging initially-remaining water in the auxiliary drum out of the auxiliary-drum by centrifugal force resulting from rotation of the main-drum before the main water-supply operation.

15. The method of claim 14, wherein the main laundry quantity detection operation and the auxiliary laundry quantity detection operation are performed after the provisional spinning operation.

* * * * *